United States Patent [19]

Aono et al.

[11] 4,430,415

[45] Feb. 7, 1984

[54] HEAT-DEVELOPABLE PHOTOGRAPHIC MATERIAL WITH FINE DROPLETS CONTAINING SILVER HALIDE, ORGANIC SILVER SALT OXIDIZING AGENT AND COLOR IMAGE FORMING SUBSTANCE

[75] Inventors: Toshiaki Aono; Hiroshi Hara; Hideki Naito; Kozo Sato, all of Kanagawa, Japan

[73] Assignee: Fuji Photo Film Co., Ltd., Kanagawa, Japan

[21] Appl. No.: 414,137

[22] Filed: Sep. 2, 1982

[30] Foreign Application Priority Data

Sep. 2, 1981 [JP] Japan ..... 56-138266

[51] Int. Cl.[3] ..... G03C 5/54; G03C 7/00; G03C 1/40; G03C 5/16

[52] U.S. Cl. ..... 430/203; 430/138; 430/351; 430/353; 430/545; 430/559; 430/619; 430/631

[58] Field of Search ..... 430/203, 138, 618, 619, 430/545, 351, 353, 631, 559

[56] References Cited

U.S. PATENT DOCUMENTS

| | | | |
|---|---|---|---|
| 3,276,869 | 10/1966 | McCune | 430/138 |
| 3,396,026 | 8/1968 | Taylor | 430/138 |
| 3,443,948 | 5/1969 | Bryan | 430/138 |
| 3,761,273 | 9/1973 | Miller et al. | 430/619 |
| 4,021,240 | 5/1977 | Cerquone et al. | 430/203 |
| 4,022,617 | 5/1977 | McGockin | 430/203 |
| 4,235,957 | 11/1980 | Kohrt et al. | 430/203 |

OTHER PUBLICATIONS

Simones et al., "Photothermographic Materials", *Research Disclosure,* No. 17707, 1/79, pp. 10 & 11.

*Primary Examiner*—Richard L. Schilling
*Attorney, Agent, or Firm*—Sughrue, Mion, Zinn, Macpeak and Seas

[57] ABSTRACT

A heat-developable color photographic material is disclosed. The material is comprised of a support having thereon a layer containing fine droplets of complex coacervate containing a light-sensitive silver halide, an organic silver salt oxidizing agent and a color image forming substance which are prepared by complex coacervation and hardened with a hardening agent. Color fog does not occur with the material and it can be easily prepared to provide a color image having good color balance by imagewise exposure to light and a heat development procedure. A process for forming a color image using the heat-developable color photographic material is also disclosed.

55 Claims, No Drawings

HEAT-DEVELOPABLE PHOTOGRAPHIC MATERIAL WITH FINE DROPLETS CONTAINING SILVER HALIDE, ORGANIC SILVER SALT OXIDIZING AGENT AND COLOR IMAGE FORMING SUBSTANCE

FIELD OF THE INVENTION

The present invention relates to a heat-developable color photographic material which can form a color image upon heat development after imagewise exposure. In particular, the present invention relates to a novel heat-developable color photographic material containing a packet emulsion comprising colloid complex coacervates in which a silver halide, an organic silver salt oxidizing agent and a color image forming substance are enclosed by a complex coacervation method. The present invention further relates to a novel heat-developable color photographic material with which a color image is obtained by transferring a dye formed or released upon heat development.

BACKGROUND OF THE INVENTION

At the present time, photographic processes using silver halide have been most widely used because of their excellent photographic properties such as sensitivity or control of gradation, etc., as compared with other photographic processes, such as an electrophotographic process or a diazo photographic process. However, recently many techniques have been developed which are capable of easily and quickly obtaining images by changing the conventional wet process using a developing solution into a dry process such as a process using heat.

Heat-developable photographic materials are known in the field of these techniques, and heat-developable photographic materials and processes have been described in U.S. Pat. Nos. 3,152,904, 3,301,678, 3,392,020 and 3,457,075, British Pat. Nos. 1,131,108 and 1,167,777, and Research Disclosure, No. 17029, pages 9 to 15 (June, 1978).

Many different processes for obtaining color images have been proposed. With respect to processes for forming color images by the reaction of an oxidation product of a developing agent with a couplers, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Patent No. 802,519 and the combination of a sulfonamidophenol type reducing agent and a 4-equivalent coupler as described in U.S. Pat. No. 4,021,240.

Another process comprises introducing a nitrogen containing heterocyclic group into a dye, forming a silver salt and releasing a dye by heat development. This process is described in Research Disclosure, No. 16966, pages 54 to 58 (May, 1978).

Also, processes for forming a positive color image by a heat developable dye bleach process, with useful dyes and methods for bleaching have been described, for example, in Research Disclosure, No. 14433, pages 30 to 32 (April, 1976), ibid., No. 15227, pages 14 to 15 (December, 1976) and U.S. Pat. No. 4,235,957.

Moreover, a process for forming a color image utilizing a leuco dye has been described, for example, in U.S. Pat. Nos. 3,985,565 and 4,022,617.

However, these known processes have a serious drawback, that is, the gradual formation of color fog. The fog occurs because of the oxidation reduction reaction or color forming reaction, etc., which gradually occurs during storage of the photographic material. The fog forming reactions occur due to the presence of a silver halide, an organic silver salt oxidizing agent, a color image forming substance and a reducing agent all in contact with each other.

The above mentioned processes are also undesirable because discoloration and/or fading of the color image or coloration of the white background portion, etc., occurs because developed silver, a color image and the remaining developing agent are coexistent after the heat development procedure. To eliminate this disadvantage, there has been proposed a process which comprises transferring the resulting color image by heat to an image receiving sheet in the presence of a solvent such as methanol, etc., as described in U.S. Pat. Nos. 3,531,286, 3,761,270 and 4,021,240, etc. However, when obtaining a multicolor image, it is necessary, for example, to conduct the heat transfer from a multilayer heat-developable color photographic element comprising at least a yellow color image forming layer, a magenta color image forming layer and a cyan color image forming layer. Accordingly, the process tends to hardly transfer the dye from the color image forming layer which is located far from the image receiving sheet. This results in destroying the color balance which is a serious defect.

Furthermore, when preparing a coating solution of these heat-developable color photographic materials, various components such as a silver halide, an organic silver salt oxidizing agent, a reducing agent and a coloring material, for example, a coupler, a leuco dye, etc., and if desired, a base and a thermal solvent are coexistent and maintained at a temperature from 40° C. to 50° C. for a certain period. While maintaining these materials in solution, an oxidation reduction reaction or color forming reaction occurs resulting in the degradation of image quality. For example, coloration of the white background portion of the heat-developable color photographic material may occur, which is also a problem.

SUMMARY OF THE INVENTION

The present invention provides a heat-developable color photographic material having a novel structure eliminating the drawbacks of heretofore known photographic materials and a method for producing the material.

Therefore, an object of the present invention is to provide a heat-developable color photographic material having a novel structure which does not form color fog even it is preserved for a long period of time.

Another object of the present invention is to provide a heat-developable color photographic material having excellent transferability.

Still another object of the present invention is to provide a heat-developable color photographic material capable of forming a color image having good color balance.

A further object of the present invention is to provide a heat-developable color photographic material which is prepared by a production method free from the occurrence of color fog.

A still further object of the present invention is to provide a heat-developable color photographic material prepared by a novel production method wherein an emulsion is easily coated.

These and other objects of the present invention will become more apparent from the following detailed description and examples.

These objects of the present invention are attained by a heat-developable color photographic material comprising a support having thereon a layer containing fine droplets of complex coacervate (packet emulsion) containing a light-sensitive silver halide, an organic silver salt oxidizing agent and a color image forming substance which are prepared by complex coacervation and hardened with a hardening agent.

DETAILED DESCRIPTION OF THE INVENTION

In general, the term "complex coacervation" means a phenomenon in which when two kinds of aqueous solutions of a polycationic colloid and a polyanionic colloid are mixed, there occurs a phase separation into two phases, i.e., a concentrated colloid phase (hereinafter referred to as complex coacervate) and a diluted colloid phase (hereinafter referred to as equilibrium solution) are formed due to an electrical interaction. The complex coacervate is deposited from the equilibrium solution in the form of droplets and observed as white turbidity. In this case, when complex coacervation occurred in the presence of a solid such as silver halide or a fine oil droplet, it is generally believed that the complex coacervate is deposited so as to include a solid or droplet as a core substance. As a result, an original form of a packet emulsion is created wherein a solid (such as silver halide or a fine droplet of liquid such as a coloring material) and an oil are incorporated into a coacervate fine droplet. Further, it is then hardened with a hardening agent so as not to destroy the original form in the subsequent steps for preparation of photographic material such as dissolution, coating, etc. Also, prior to the hardening step, the equilibrium solution in which an original form of a packet emulsion formed is dispersed is cooled to a temperature of 25° C. or below, preferably 10° C. or below, whereby a good quality packet emulsion is obtained.

A method of preparing a packet emulsion in which silver halide, a sensitizing agent, and if desired, a coupler, a coupler solvent or a dye developer, etc., is incorporated by complex coacervation is described in, for example, Japanese Patent Publication No. 12948/65, U.S. Pat. Nos. 3,443,748, 3,276,869, 3,443,947 and 3,396,026 (each of the U.S. patents being incorporated by reference to disclose such methods of preparation), Research Disclosure, Vol. 135, No. 13520, etc.

Research Disclosure, Vol. 187, No. 18755 (1979) describes a heat-developable color photographic material containing a packet emulsion which comprises a light-sensitive silver halide, an organic silver salt oxidizing agent, a reducing agent and a coupler incorporated therein using a hydrophobic polymer such as polyvinyl butyral as a wall material. However, this photographic material is not desirable because a large amount of organic solvent is required for the preparation of the packet emulsion. Furthermore, since the reducing agent is coexistent in the packet emulsion, the reducing agent is oxidized during the preparation of the packet emulsion or the preservation of the photographic material containing the packet emulsion. Therefore, color fog is apt to occur.

The hydrophilic colloids which can be used in the complex coacervation are classified into two groups. A first group comprises compounds containing a nitrogen atom and an aqueous solution thereof has a negative charge at a pH higher than its isoelectric point and a positive charge at a pH lower than its isoelectric point (i.e., a cationic compound or polymer). Examples of these compounds include gelatin, casein, albumen, hemoglobin, polyvinyl pyrrolidone, etc. A second group comprises compounds, an aqueous solution of which, always has a negative charge irrespective of pH (i.e., an anionic compound or polymer). Examples of these compounds include a natural colloid such as sodium alginate, gum arabic, agar, pectin, konjak, etc., a synthetic polymer having an acid group or an alkali salt thereof such as a copolymer of polyvinyl methyl ether or polyethylene and maleic anhydride, carboxymethyl cellulose, polyvinylsulfonic acid, a condensation product of naphthalenesulfonic acid and formalin, etc., or a gelatin derivative in which a portion capable of having a positive charge is masked by phthalation or acetylation, etc. Preferred examples of the anionic polymer which can be used in the present invention include a compound having a repeating unit containing a $COO^-$ group, an $SO_3^-$ group or both groups and having a molecular weight of not less than 1,000, preferably not less than 3,000. Of the compounds belonging to these two groups, gelatin, agar, sodium alginate, etc., can be gelated by cooling. Gelatin is most suitable for the preparation of the packet emulsion in view of its reversibility, that it is gelated by cooling and it is easily hardened with a hardening agent.

In the practice of the present invention, at least one species is preferably selected from each of the above described groups and at least one of the species thus selected is a compound capable of gelation by cooling. It is preferred to use a combination of gelatin and an anionic polymer. The amount of the colloidal substance used varies depending on the charge density of the substance at the time of coacervation formation. However, a substance of one group is generally used in a range of from 1/20 to 20 times the amount by weight of a compound of the other group. It is preferred to use a weight ratio from 0.5:1 to 4:1 in a combination of gelatin and gum arabic and a weight ratio from 10:1 to 40:1 in a combination of gelatin and a condensation product of naphthalenesulfonic acid and formalin.

In order to cause the complex coacervation, the following four conditions are required.

Firstly, the concentration of hydrophilic colloid in both the first group and the second group must be in the range of from 0.5 to 6%, preferably from 1 to 4%.

Secondly, the pH must not be more than 5.5. The size of the packet emulsion varies widely depending on the pH value. The optimum pH value varies depending on the kind of colloid used, but in most cases it is in the range of from 5.20 to 4.00, preferably from 5.00 to 4.50. Also, the size of the packet emulsion used is usually in the range of from 1 to 100 μm, preferably from 2 to 60 μm, and most preferably from 5 to 30 μm.

Thirdly, the temperature of the system must be higher than the gelation temperature of the aqueous colloid solution. In the case of gelatin, the temperature must not be less than 35° C., and is preferably in the range of from 40° to 55° C.

Fourthly, the amount of inorganic salt coexistent must be lower than a certain critical value (the critical value varies depending on the kind of salt).

Preparation of the packet emulsion by complex coacervation is generally carried out by one of the following two methods.

In accordance with the first method, hydrophilic colloids each of which is selected from the first group and the second group are mixed in an appropriate ratio and an aqueous solution thereof in a concentration of 1 to 4% is prepared. The temperature of the solution is maintained in a range of from 35° to 60° C. and the pH is kept more than 5.5. The pH is reduced by adding an acid whereby coacervation occurs.

In accordance with the second method, a temperature (not less than 35° C.) and a pH (not more than 5.5) are maintained under a condition under which the coacervation occurs and an aqueous hydrophilic colloid solution having a concentration of at least 6% is diluted by adding warm water and the concentration of the colloid is changed into a coacervation forming condition.

However, when a packet emulsion is prepared by the first or second method or both, the amount of the packet emulsion is very small in comparison with the volume of the diluted continuous phase of hydrophilic colloid. Therefore, a large amount of a binder must be added so that it can be directly used as a coating solution. Thus, a thickness of the coating layer increases which results in curling of the photographic material and decreased transferability. Various methods can be applied to concentrate or dry the packet emulsion. In accordance with one known method, the diluted colloid solution containing a packet emulsion dispersed therein is filtered. In accordance with another method, the colloid solution is allowed to stand and precipitate the packet emulsion. The supernatant fluid is then removed by decantation. Also, in order to promote precipitation, a centrifugal separator can be used. Further, in order to completely remove water, the packet emulsion may be pulverized by using spray drying methods which are well known in the preparation of microcapsules.

The silver halide which is incorporated into the packet emulsion used in the present invention can be spectrally sensitized so as to be sensitive to green light, red light or, if desired, infrared light with a sensitizing dye before the occurrence of complex coacervation. Each of these spectrally sensitized silver halides is combined with a corresponding color image forming substance and incorporated into packets together with an organic silver salt oxidizing agent. For example, a combination of a blue-sensitive silver halide and a yellow color image forming substance, a combination of a green-sensitive silver halide and a magenta color image forming substance and a red-sensitive silver halide and a cyan color image forming substance or a combination of a green-sensitive silver halide emulsion and a yellow color image forming substance, a combination of a red-sensitive silver halide emulsion layer and a magenta color image forming substance, and a combination of an infrared (700 to 800 nm) sensitive silver halide emulsion and a cyan color image forming substance can be employed. These three kinds of packet emulsions are mixed and combined with an alkali agent and a reducing agent and the mixture containing a hydrophilic colloid as a binder is coated on a support to obtain a heat-developable color photographic material. When two kinds of packet emulsions are used in a mixture it results in a heat-developable photographic material for two color images. Further, two kinds of yellow, magenta and cyan color image forming elements are mixed as a packet emulsion and another is added to a continuous phase of a hydrophilic binder together with a silver halide, an organic silver salt oxidizing agent, a color image forming substance, a reducing agent and, if desired, a color forming activator such as a base, which forms the same layer containing the packet emulsion or an adjacent layer thereto.

Examples of hardening agents which can be used for the preparation of the packet emulsion according to the present invention include chromium salts (for example, chrome alum, chromium acetate, etc.), aldehydes (for example, formaldehyde, glyoxal, glutaraldehyde, etc.), N-methylol compounds (for example, dimethylol urea, methylol dimethylhydantoin, etc.), dioxane derivatives (for example, 2,3-dihydroxydioxane, etc.), active vinyl compounds (for example, 1,3,5-triacryloylhexahydro-s-triazine, 1,3-vinylsulfonyl-2-propanol, etc.), active halogen compounds (for example, 2,4-dichloro-6-hydroxy-s-triazine, etc.), and mucohalogenic acids (for example, mucochloric acid, mucophenoxychloric acid, etc.). These hardening agents can be used individually or in a mixture thereof.

In addition to the above described compounds, those described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827 and 3,543,292, British Pat. Nos. 676,628, 825,544 and 1,270,578, German Patent Nos. 872,153 and 1,090,427, Japanese Patent Publication Nos. 7133/59 and 1872/71, and Research Disclosure, Vol. 176, page 26 (December, 1978), etc., can be used.

The heat-developable color photographic material of the present invention can provide a silver image (i.e., a metal silver) corresponding to the object and a color image due to the formation or bleaching of dyes on the part corresponding to the silver image by carrying out heat development at a temperature range from 80° C. to 250° C., preferably from 120° C. to 190° C., after imagewise exposure to light. The formation or bleaching of dyes is performed in a different process depending on the kind of the color image forming substance and includes, for example, the following processes:

(1) formation of a dye by bonding of an oxidized product of a reducing agent which is formed upon the oxidation-reduction reaction between an organic silver salt oxidizing agent and a reducing agent with a coupler.

(2) releasing of a diffusible dye by the reaction of a coupler having a diffusible dye as a releasable group with the oxidized product described above.

(3) releasing of a diffusible dye by the oxidation-reduction reaction between an organic silver salt oxidizing agent and a dye releasing redox compound and the subsequent attack with a nucleophilic agent.

(4) releasing of a diffusible dye by the oxidation-reduction reaction between a silver salt of silver salt forming dye and a reducing agent.

(5) formation of a dye by the oxidation-reduction reaction between a leuco body of a dye or a precursor thereof and an organic silver salt oxidizing agent.

(6) bleaching of a dye with a metal silver.

The process of (1) is described, for example, in U.S. Pat. Nos. 3,531,286, 3,761,270 and 4,021,240 (incorporated herein by reference to disclose such a process), Belgian Patent No. 802,519, Research Disclosure, Vol. 139, No. 13946.

The process of (2) is described, for example, in Japanese Patent Application Nos. 71234/81 and 93533/81.

The process of (3) is described, for example, in Japanese Patent Application Nos. 65391/81 and 84164/81.

The process of (4) is described, for example, in Research Disclosure, Vol. 169, No. 16966.

The process of (5) is described, for example, in U.S. Pat. Nos. 3,985,565 and 4,022,617 (incorporated herein by reference to disclose such a process).

The process of (6) is described, for example, in Research Disclosure, Vol. 144, No. 14433, ibid., Vol. 152, No. 15227, U.S. Pat. No. 4,235,957 (incorporated herein by reference to disclose such a process).

The process of (1) comprises forming a dye by the reaction of an oxidized product of a reducing agent which is formed upon the reaction of a reducing agent a typical example of which includes an aromatic primary amine, a hydrazine compound and a derivative thereof, particularly a p-aminophenol derivative or a phenylenediamine derivative with an organic silver salt oxidizing agent with a coupler, that is, a phenol, a naphthol, an active methylene compound or an active methine compound represented by the following general formulae (I) to (VI):

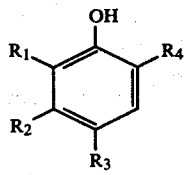
(I)

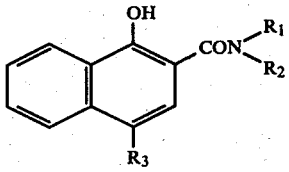
(II)

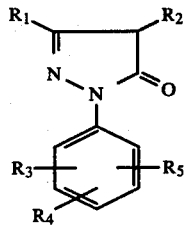
(III)

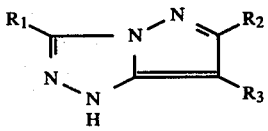
(IV)

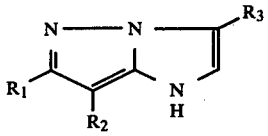
(V)

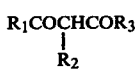
(VI)

wherein $R_1$, $R_2$, $R_3$, $R_4$ and $R_5$, which may be the same or different, each represents hydrogen or a substituent selected from the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group, a cyano group, an alkylsulfonyloxy group, an arylsulfonyloxy group, an alkylsulfonylamino group, an arylsulfonylamino group, an alkylthio group, an arylthio group, an arylazo group, a heterocyclic residue,

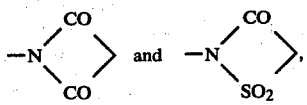

and these substituents may be further substituted with a hydroxyl group, a carboxyl group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

It is preferred that $R_1$, $R_2$, $R_3$, $R_4$ and $R_5$ have in all from 8 to 40 carbon atoms.

The process of (2) comprises releasing a diffusible dye by the reaction of a color image forming substance which has a releasable group containing the dye at the coupling position of a coupler and is represented by the general formula (VII) below with the above described oxidized product of the reducing agent (preferably an aromatic primary amine) and transferring the dye into an image receiving element.

C—L—D (VII)

wherein C represents a substratum capable of bonding to an oxidized product which is formed by a reaction between a reducing agnet and an organic silver salt oxidizing agent; D represents a dye portion for forming a color image; and L represents a connecting group between C and D and the bond between C and L is cleaved upon the reaction of C with the oxidized product of the reducing agent.

The substratum represented by C is capable of bonding to an oxidized product which is formed by a reaction between a reducing agent and an organic silver salt oxidizing agent and includes an active methylene residue, an active methine residue, a phenol residue or a naphthol residue. Examples of the substrata are represented by the following general formulae (VIII) to (XIV):

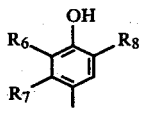
(VIII)

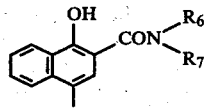
(IX)

-continued (X)

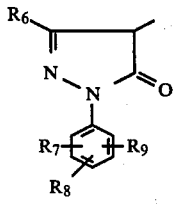

(XI)

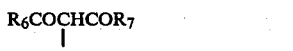

(XII)

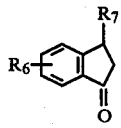

(XIII)

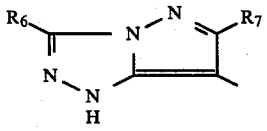

(XIV)

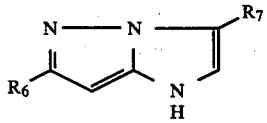

wherein $R_6$, $R_7$, $R_8$ and $R_9$, which may be the same or different, each represents hydrogen or a substituent selected fron the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group and a cyano group, and these substituents may be further substituted with a hydroxyl group, a carboxyl group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

It is preferred that $R_6$, $R_7$, $R_8$ and $R_9$ have in all from 6 to 30 carbon atoms.

L represents a divalent residue connecting C and D with a covalent bond and having the total number of the carbon atoms contained of not more than 12, and D represents a color image forming dye.

The process of (3) comprises releasing a diffusible dye by the oxidation of a dye releasing redox compound by the reaction of the dye releasing redox compound which is a color image forming substance having a reducing property and is represented by the general formula (XV) below with an organic silver salt oxidizing agent and the subsequent action with a nucleophilic agent.

$$R—SO_2—D \qquad (XV)$$

wherein R represents a reducing substratum capable of being oxidized by an organic silver salt oxidizing agent, and D represents a dye portion for forming a color image.

Examples of the reducing substrata are represented by the following general formulae (XVI) to (XXIII):

(XVI)

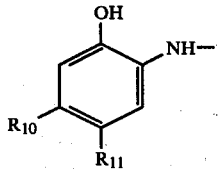

(XVII)

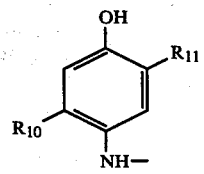

(XVIII)

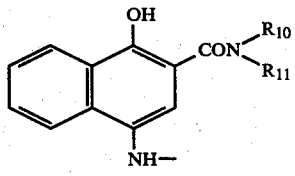

(XIX)

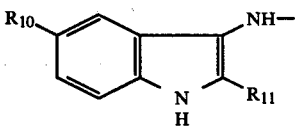

(XX)

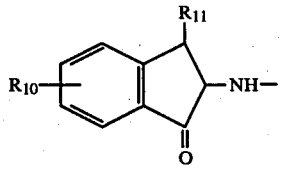

(XXI)

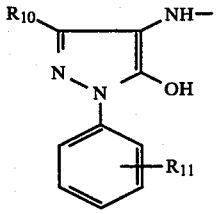

(XXII)

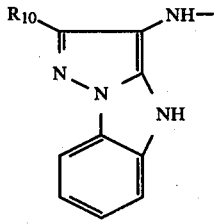

(XXIII)

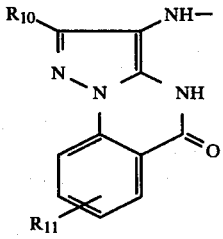

wherein $R_{10}$ and $R_{11}$ each represents hydrogen or a substituent selected from the group consisting of an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group or an N-substituted sulfamoyl group, which may be further substituted by a hydroxyl group, a carboxyl group, a sulfo group, a cyano group, a sulfamoyl group, a carbamoyl group, an acylamino group, an alkylsulfonylamino group, an arylsulfonylamino group, a ureido group or a substituted ureido group.

It is preferred that $R_{10}$ and $R_{11}$ have in all from 6 to 30 carbon atoms.

The process of (4) utilizes the phenomenon in which a metal silver is released from a silver salt of silver salt forming dye by the oxidation-reduction reaction between the silver salt of silver salt forming dye represented by the general formula (XXIV) below and a reducing agent and the silver salt forming dye becomes diffusible. In this case, the silver salt of silver salt forming dye is not only an organic silver salt oxidizing agent but also a color image forming substance.

D—AH (XXIV)

wherein D represents a dye portion for forming a color image; and AH represents a group having a silver salt forming function.

Examples of AH include an aliphatic or aromatic carboxylic acid group, a sulfonic acid group, a phosphoric acid group, a mercapto group, a group of >NH, a phenolic hydroxy group, etc.

The process of (5) comprises oxidizing a leuco body to an original dye by the oxidation-reduction reaction between a leuco body (reduced form) of a dye capable of being reduced or a precursor thereof and an organic silver salt oxidizing agent to obtain a color image. Examples of the dye capable of being reduced include an azo dye, an azomethine dye, an anthraquinone dye, a naphthoquinone dye, a triarylmethane dye, a xanthene dye, an azine dye, an indigoid dye, a formazane dye, a nitro dye, a nitroso dye, an azoxy dye, etc. In the present invention, a leuco body of an azomethine dye, an anthraquinone dye, a naphthoquinone dye, a triarylmethane dye, a xanthene dye, an azine dye and an indigoid dye are particularly useful.

Further, the leuco body of the above described dye can be used as a precursor thereof. Where a leuco body is sensitive to oxidation and tends to be readily colored, it is particularly effective to use a method of stabilizing the leuco body as a precursor thereof. The most general method of stabilizing the leuco body is a method in which a group relevant to the color formation of the leuco dye such as a hydroxy group, an amino group, etc., is protected with a hydrolizable group by acylation, sulfonylation, phosphorylation, etc.

The process of (6) comprises bleaching a bleachable dye by the action of metal silver, a silver ion complex forming agent and an electron transferring agent in the presence of an acid. Examples of the bleachable dyes include an azo dye, an azoxy dye, an azomethine dye, a triarylmethane dye, a xanthene dye, an azine dye, an anthraquinone dye, a naphthoquinone dye, an indigoid dye, a nitro dye, a nitroso dye, a formazane dye, etc. In the present invention, an azo dye is particularly useful.

Also, a precursor of an azo dye such as a hydrazo compound, a diazoamino compound, etc., is effective.

In the each process of the present invention, examples of color image forming dyes contained in the color image forming substance include an azo dye, an azomethine dye, an anthraquinone dye, a naphthoquinone dye, a nitro dye, a styryl dye, a quinophthalone dye, a triarylmethane dye, a phthalocyanine dye and a precursor thereof (for example, a leuco body, a temporary shortwave shifted body, etc.).

Characteristics required for the color image forming dye are as follows:

(1) It has a hue suitable for color reproduction.

(2) It has a large molecular extinction coefficient.

(3) It is stable to light, heat and other additives in the system, such as the reducing agent.

(4) It is easily synthesized.

Examples of the preferred color image forming dyes which satisfy the above described requirements are set forth below, but the present invention is not to be construed as being limited thereto.

Yellow:

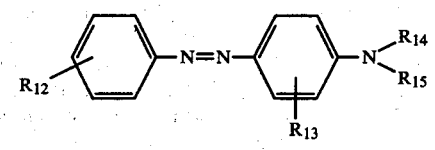

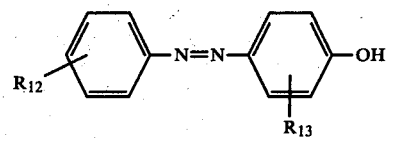

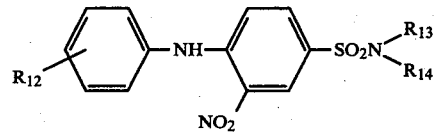

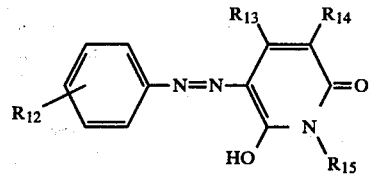

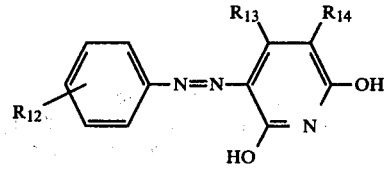

-continued
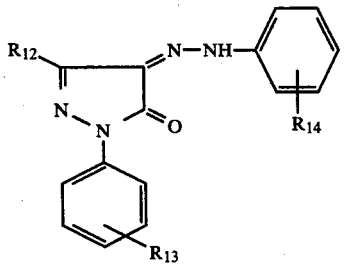
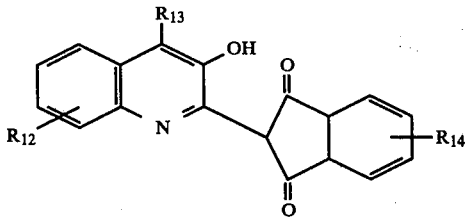
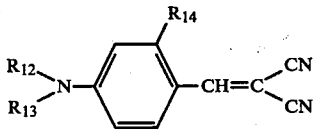
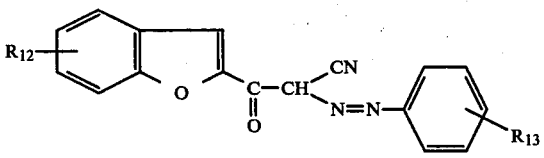
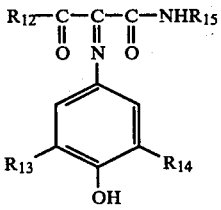
Magenta:
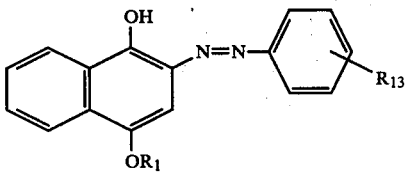
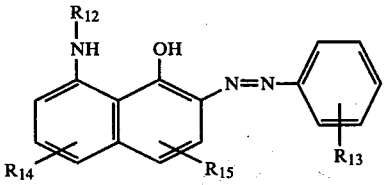
-continued
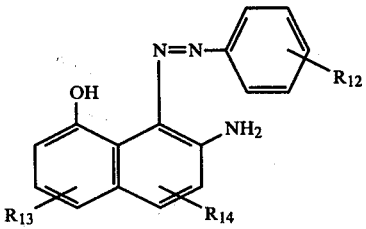
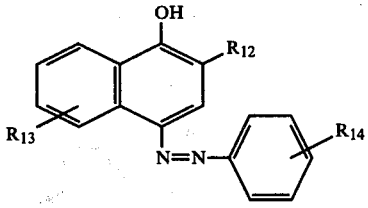
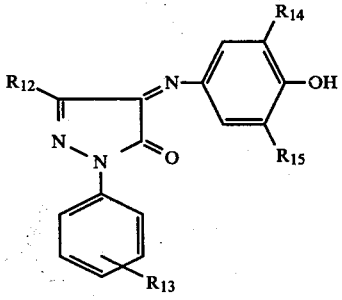
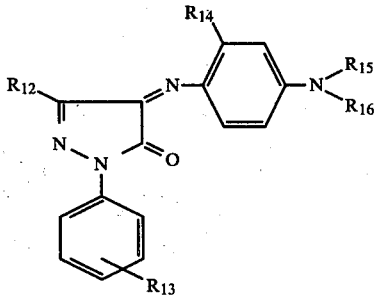
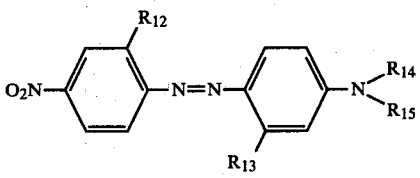
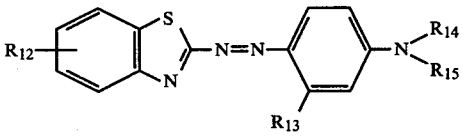
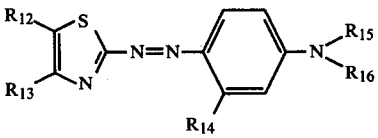

-continued
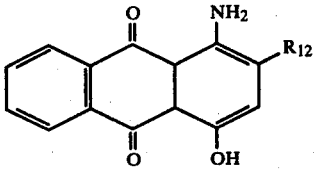
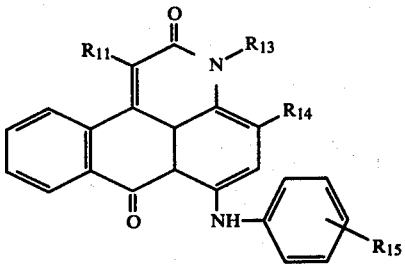
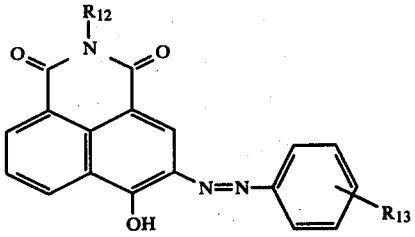
Cyan:
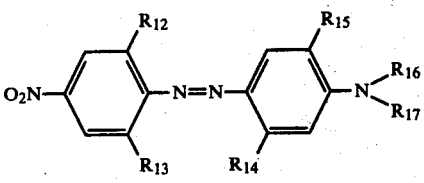
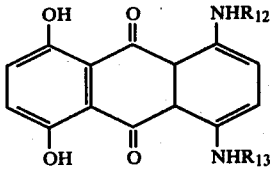
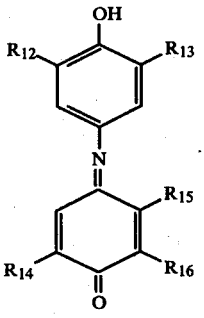
-continued
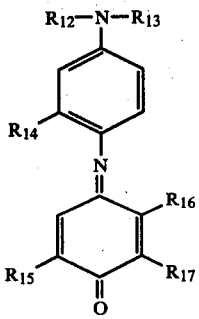
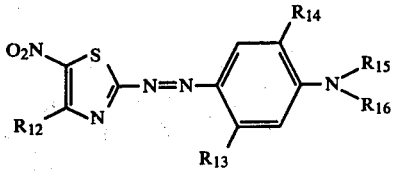
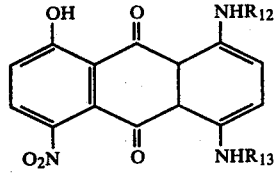
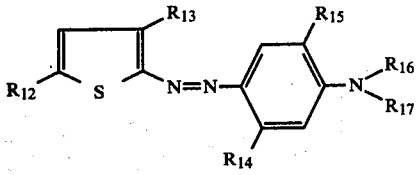
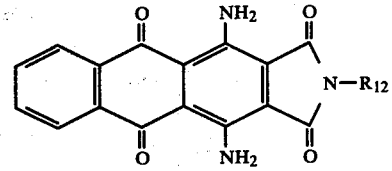
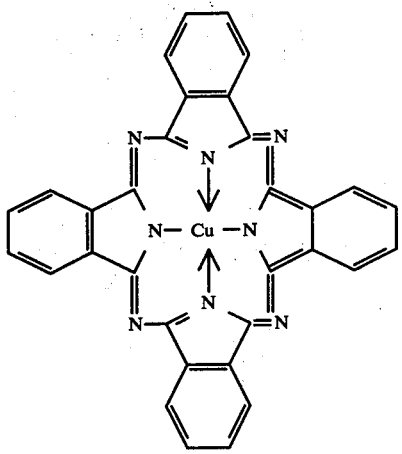
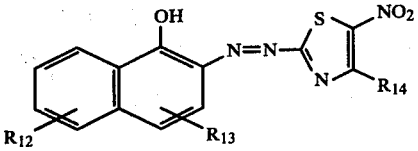

-continued

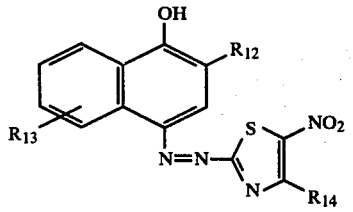

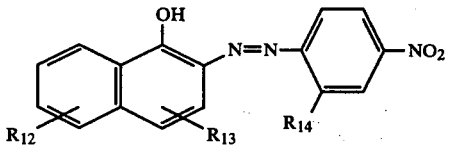

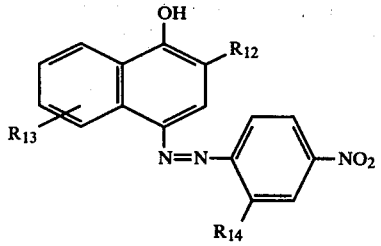

wherein $R_{12}$ to $R_{17}$ each represents hydrogen or a substituent selected from the group consisting of an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group and an arylthio group.

Specific examples of the preferred color image forming substances which can be used in the present invention are set forth below, but the present invention is not to be construed as being limited thereto.

(1) Specific examples of the couplers represented by the general formulae (I) to (VI):

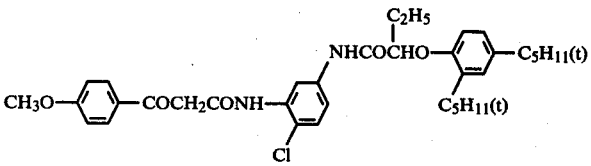

(Y-1)

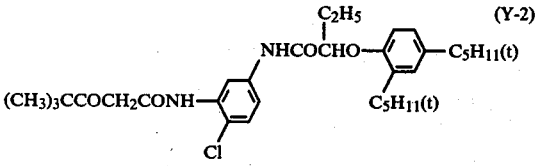

(Y-2)

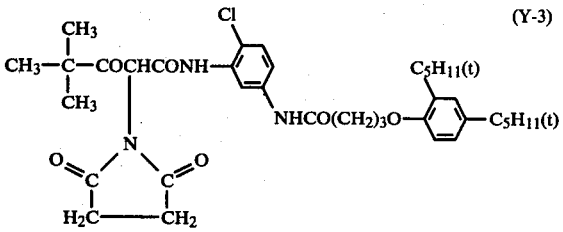

(Y-3)

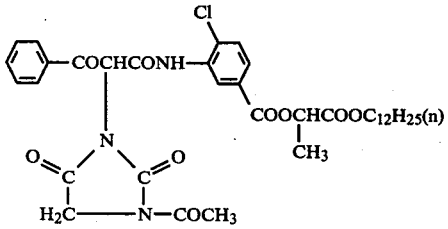

(Y-4)

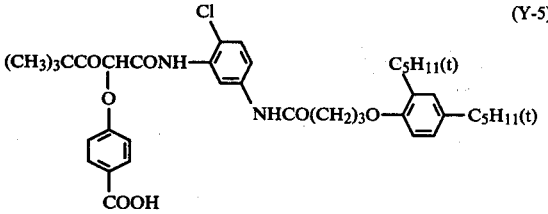

(Y-5)

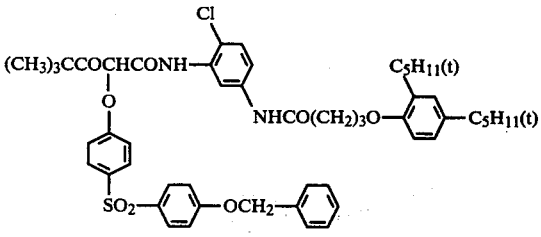

(Y-6)

-continued
(Y-7)
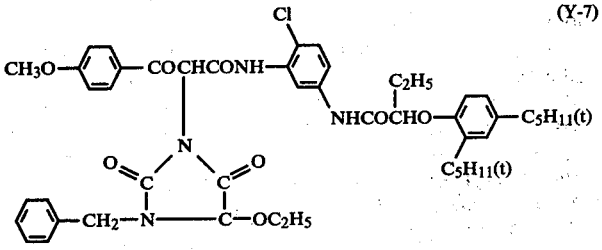
(Y-8)
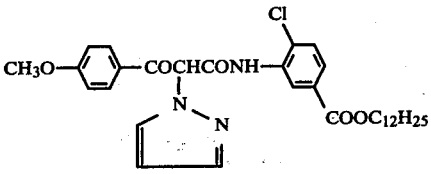
(M-1)
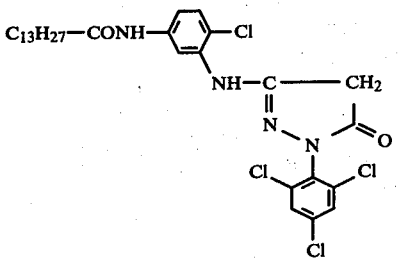
(M-2)
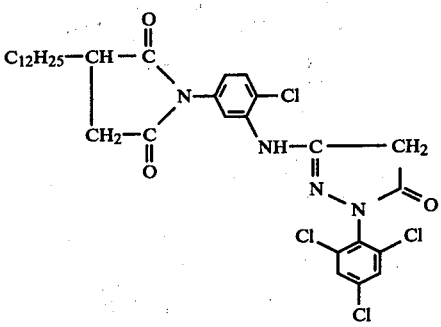
(M-3)
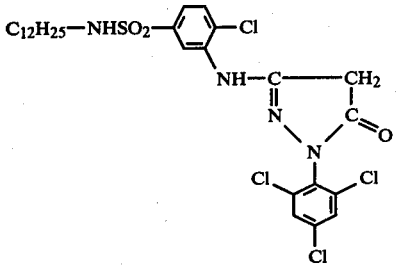
(M-4)
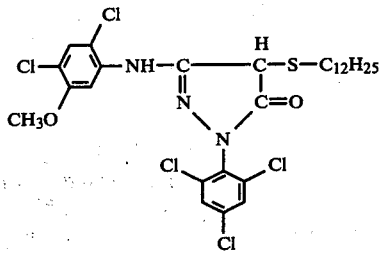
(M-5)
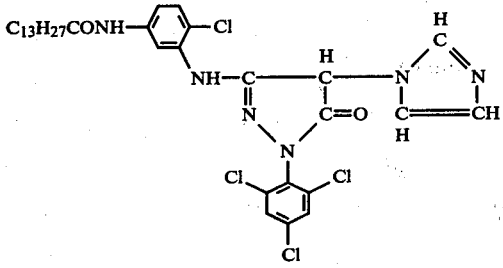
(M-6)
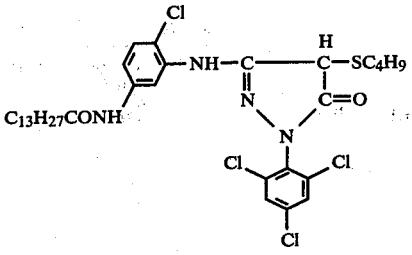
(M-7)
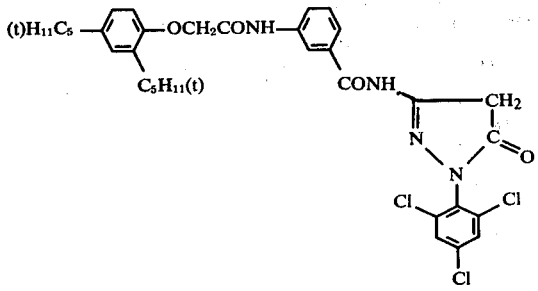
(M-8)
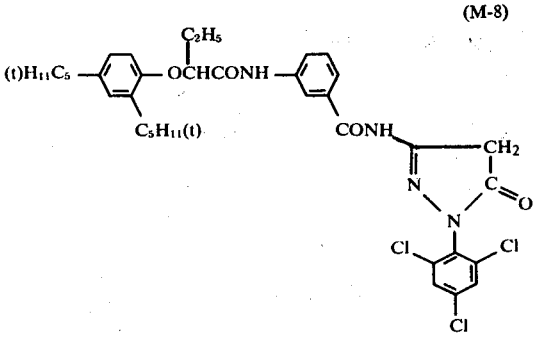
(C-1)
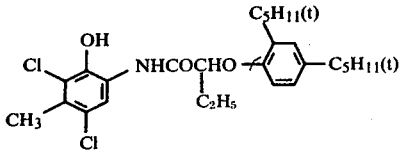
(C-2)
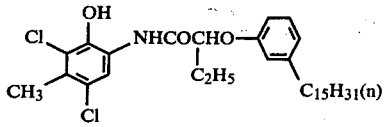

-continued
(C-3)
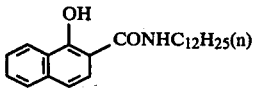
(C-4)
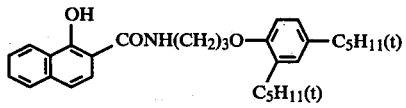
(C-5)
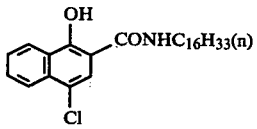
(C-6)
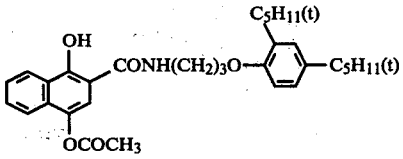
(C-7)
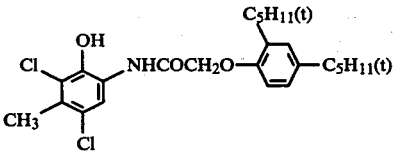
(C-8)
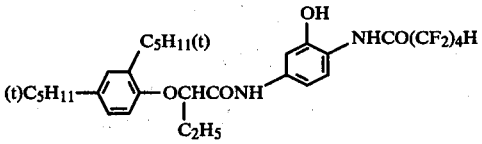
(2) Specific examples of the color image forming substances represented by the general formula (VII):
(VII-1)
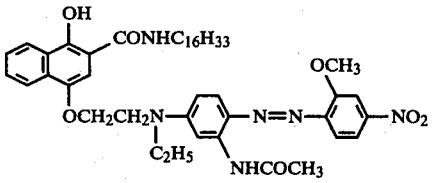
(VII-2)
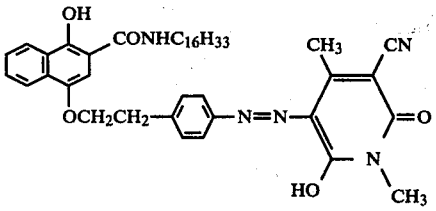
(VII-3)
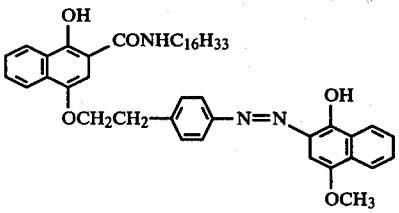
(VII-4)
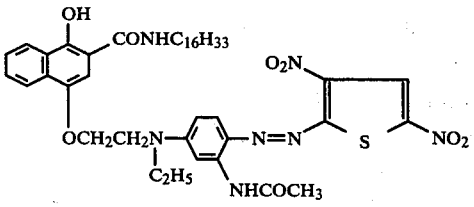
(VII-5)
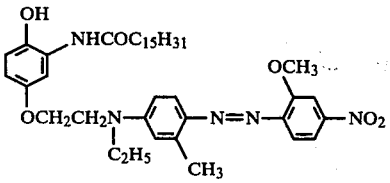
-continued
(VII-6)
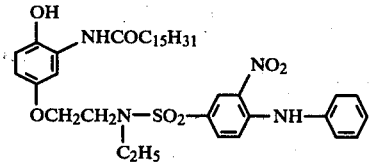
(VII-7)
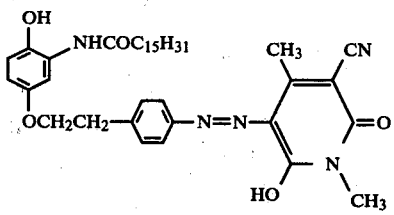
(VII-8)
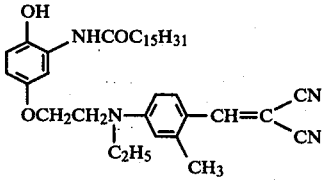
(VII-9)
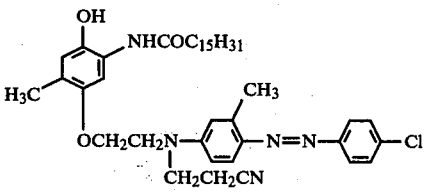
(VII-10)
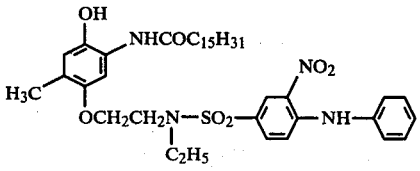

-continued
(VII-11)
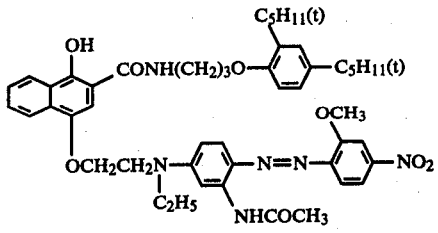
(VII-12)
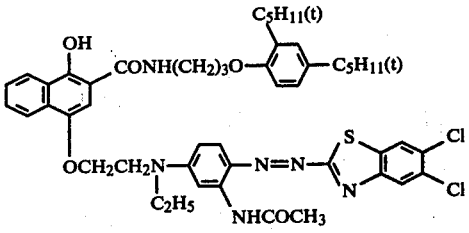
(VII-13)
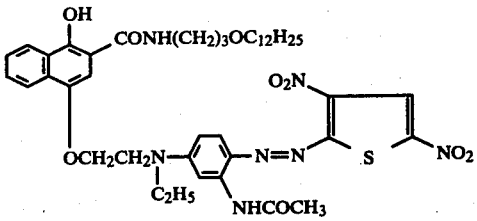
(VII-14)
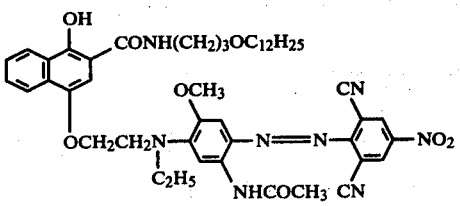
(VII-15)
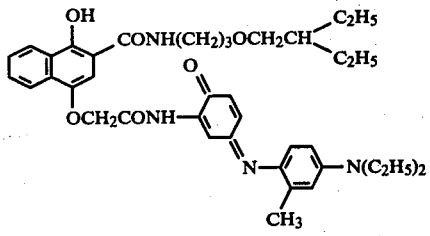
(VII-16)
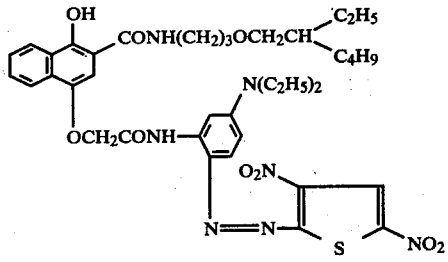
(VII-17)
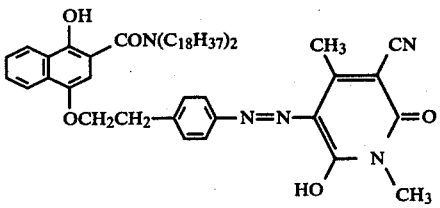
-continued
(VII-18)
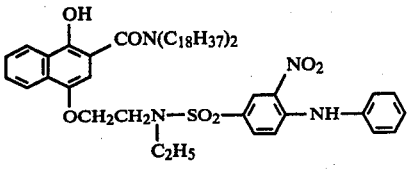
(VII-19)
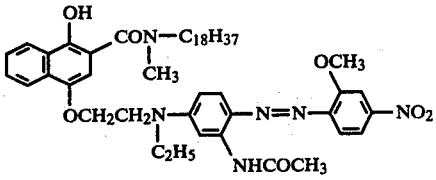
(VII-20)
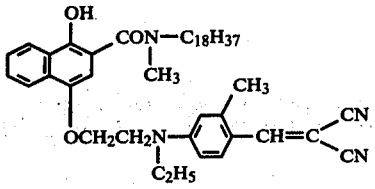
(VII-21)
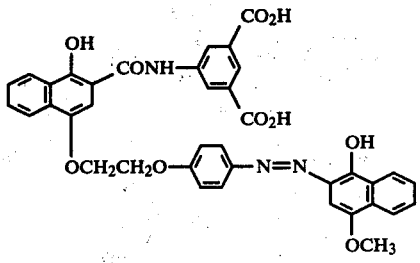
(VII-22)
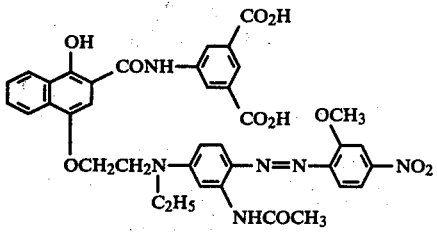
(VII-23)
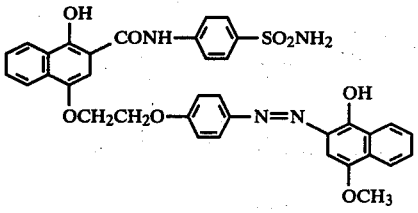
(VII-24)
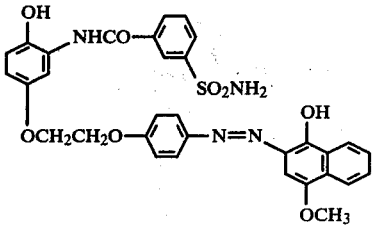

-continued
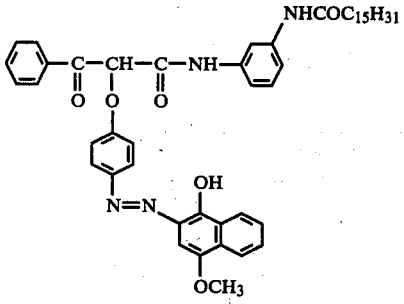
(VII-25)
(3) Specific examples of the color image forming substances represented by the general formula (XV):
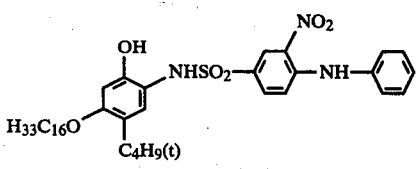
(XV-1)
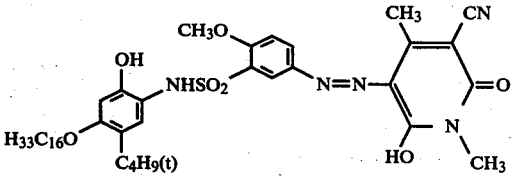
(XV-2)
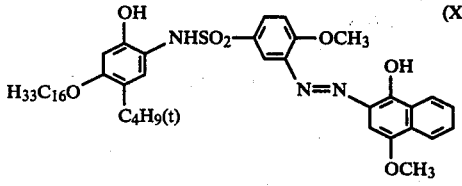
(XV-3)
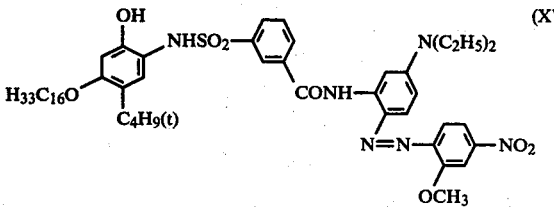
(XV-4)
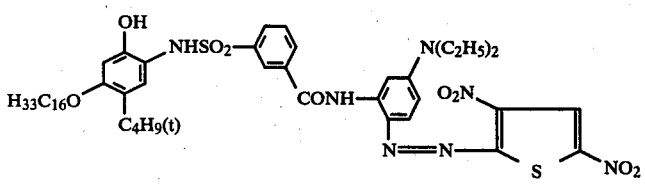
(XV-5)
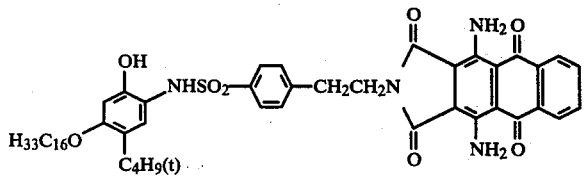
(XV-6)
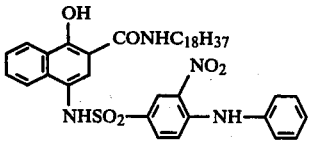
(XV-7)
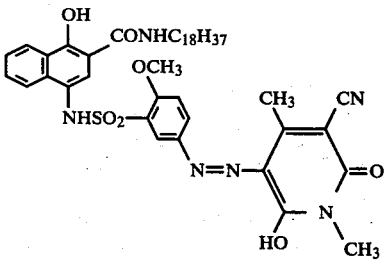
(XV-8)
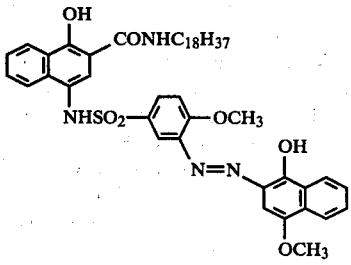
(XV-9)
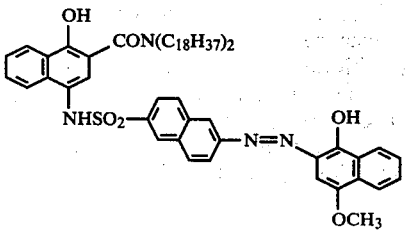
(XV-10)
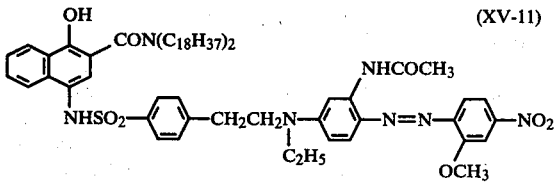
(XV-11)

-continued (XV-12)

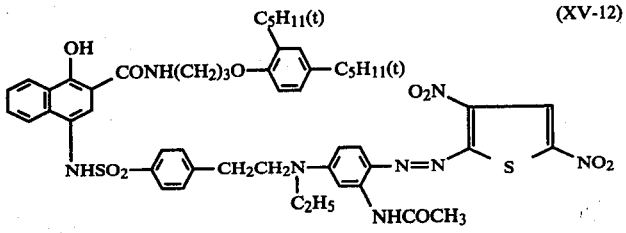

(XV-13)

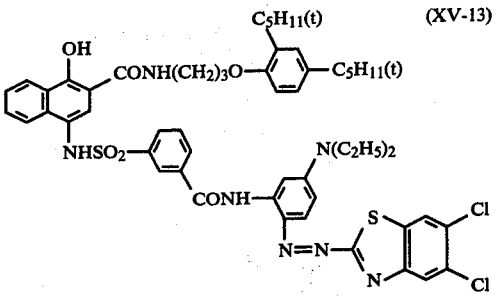

(XV-14)

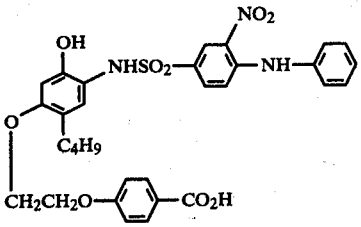

(XV-15)

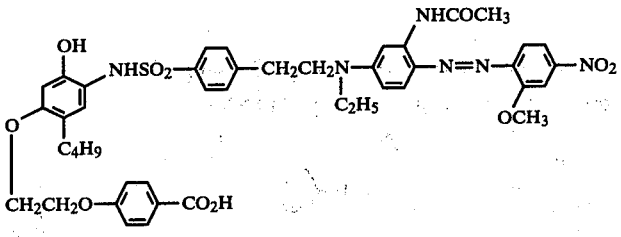

(XV-16)

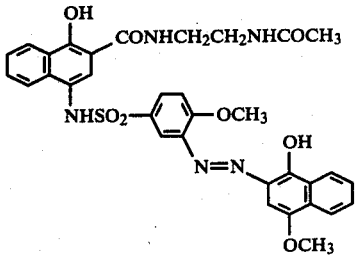

(XV-17)

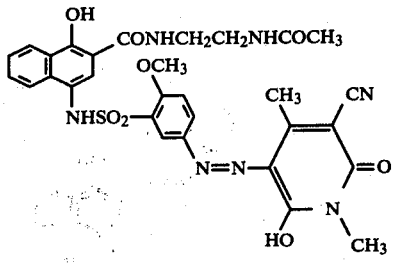

(XV-18)

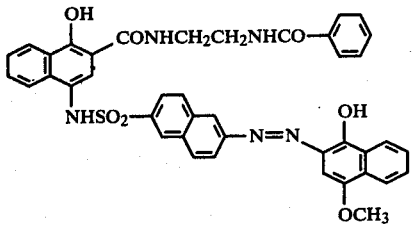

(XV-19)

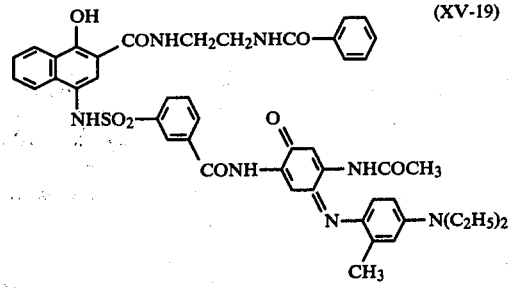

(XV-20)

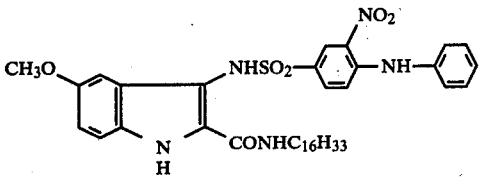

(XV-21)

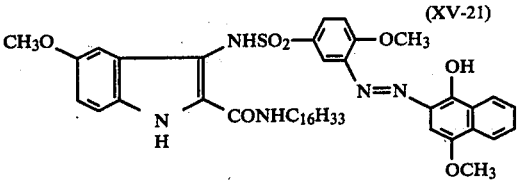

The light-sensitive silver halide used in the present invention can be employed in a range from 0.005 mol to 5 mols and, preferably, from 0.005 mol to 1.0 mol per mol of the organic silver salt oxidizing agent.

Examples of silver halide include silver chloride, silver chlorobromide, silver chloroiodide, silver bromide, silver iodobromide, silver chloroiodobromide and silver iodide, etc.

The particle size of the silver halide used is from 0.001 μm to 2 μm and, preferably, from 0.001 μm to 1 μm.

The silver halide used in the present invention may be employed as is, but it may be chemically sensitized with a chemical sensitizing agent such as a compound containing sulfur, selenium or tellurium, etc., or a compound containing gold, platinum, palladium, rhodium or iridium, etc., a reducing agent such as a tin halide, etc., or a combination thereof. The details of these procedures are described in T. H. James, The Theory of the Photographic Process, Fourth Edition, Chapter 5, pages 149 to 169.

The organic silver salt oxidizing agent which can be used in the present invention is a silver salt which is comparatively stable to light and which forms a silver image by reacting with the above described image forming substance or a reducing agent coexisting, if necessary, with the image forming substance, when it is heated to a temperature of above 80° C. and, preferably, above 100° C. in the presence of exposed silver halide.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver fuorate, silver linolate, silver oleate, silver adipate, silver sebacate, silver succinate, silver acetate, silver butyrate and silver camphorate, etc. These silver salts which are substituted with a halogen atom or a hydroxyl group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-metnylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and a silver salt of an aliphatic carboxylic acid containing a thioether group as described in U.S. Pat. No. 3,330,663, etc.

In addition, a silver salt of a compound containing mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(s-ethylglycolamido)-benzothiazole, a silver salt of thioglycolic acid such as a silver salt of an s-alkyl thioglycolic acid (wherein the alkyl group has from 12 to 22 carbon atoms), as described in Japanese Patent Application (OPI) No. 28221/73 (the term "OPI" as used herein refers to a "published unexamined Japanese patent application"), a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an amino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Preferred examples of the organic silver salt oxidizing agent which can be used in the present invention include an N-containing organic silver salt oxidizing agent and a silver salt of a triazole.

Moreover, a silver salt as described in Research Disclosure, Vol. 170, No. 17029 (June, 1978) and an organic metal salt such as copper stearate, etc., can be used instead of the organic silver salt oxidizing agent of the present invention.

The silver halide and the organic silver salt oxidizing agent which form a starting point of development should be present within a substantially effective distance.

For this purpose, it is desired that the silver halide and the organic silver salt oxidizing agent are present in the same layer.

The silver halide and the organic silver salt oxidizing agent which are separately formed in a hydrophobic binder can be mixed prior to use to prepare a coating solution, but it is also effective to blend both of them in a ball mill for a long period of time. Further, it is effective to use a process which comprises adding a halogen containing compound to the organic silver salt oxidizing agent prepared to form silver halide using silver of the organic silver salt oxidizing agent.

Methods of preparing these silver halide and organic silver salt oxidizing agent and manners of blending them are described in Research Disclosure, No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total from 50 mg to 10 g/m$^2$ calculated as an amount of silver.

The light-sensitive silver halide and the organic silver salt oxidizing agent used in the present invention are prepared in the binder as described below.

The binder which can be used in the present invention can be employed individually or in a combination of two or more. While both of a hydrophilic polymer and a hydrophobic polymer can be used as the binder according to the present invention, the hydrophilic polymer is particularly preferred. The typical hydrophilic binder is a transparent or translucent hydrophilic colloid, examples of which include a natural substance, for example, protein such as gelatin, a gelatin derivative, a cellulose derivative, a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing a dimensional stability of a photographic material.

The reducing agent which can be used in the present invention is oxidized by the organic silver salt oxidizing agent to form an oxidized product capable of reacting with the dye releasing compound and releasing a dye to form a color image. An example of an effectively used reducing agent having such an ability is a color developing agent capable of forming an image upon oxidative coupling. Examples of the reducing agents used in the heat-developable color photographic material according to the present invention include a p-phenylenediamine type color developing agent including N,N-diethyl-3-methyl-p-phenylenediamine which is a typical example as described in U.S. Pat. No. 3,531,268. Further, an example of an effective reducing agent is an aminophenol as described in U.S. Pat. No. 3,761,270. Of the aminophenol type reducing agents, 4-amino-2,6-dichlorophenol, 4-amino-2,6-dibromophenol, 4-amino-2-methylphenol sulfate, 4-amino-3-methylphenol sulfate, 4-amino-2,6-dichlorophenyl hydrochloride, etc., are particularly useful. Further, a 2,6-dichloro-4-substituted sulfonamidophenol, and a 2,6-dibromo-4-substituted sulfonamidophenol, etc., as described in Research Disclosure, Vol. 151, No. 15108 and U.S. Pat. No. 4,021,240 are also useful. In addition to the phenol type reducing agents described above, a naphthol type reducing agent, for example, a 4-aminonaphthol derivative and a 4-substituted sulfonamidonaphthol derivative is useful. Moreover, a generally applicable color developing agent, an aminohydroxy pyrazole derivative as described in U.S. Pat. No. 2,895,825, an aminopyrazoline derivative as described in U.S. Pat. No. 2,892,714, a hydrazone derivative as described in Research Disclosure, pages 227 to 230 and 236 to 240, Nos. RD-19412 and RD-19415 (June, 1980) may also be used. These reducing agents can be used individually or in a combination of two or more thereof.

In addition to the above described reducing agent, a reducing agent described below may be used as an auxiliary developing agent. Examples of useful auxiliary developing agents include hydroquinone, a alkyl substituted hydroquinone such as tertiary butylhydroquinone or 2,5-dimethylhydroquinone, etc., a catechol, a pyrogallol, a halogen substituted hydroquinone such as chlorohydroquinone or dichlorohydroquinone, etc., an alkoxy substituted hydroquinone such as methoxyhydroquinone, etc., and a polyhydroxybenzene derivative such as methyl hydroxynaphthalene, etc. Further, methyl gallate, ascorbic acid, an ascorbic acid derivative, a hydroxylamine such as N,N'-di(2-ethoxyethyl)-hydroxylamine, etc., a pyrazolidone such as 1-phenyl-3-pyrazolidone or 4-methyl-4-hydroxymethyl-1-phenyl-3-pyrazolidone, etc., a reductone and a hydroxy tetronic acid are also useful.

The reducing agent can be used in a certain range of concentration. In general, a suitable concentration range of the reducing agent is from about 0.1 mol to about 4 mols of the reducing agent per mol of the oxidizing agent. A suitable concentration of the reducing agent used in the present invention is generally from about 0.1 mol to about 20 mols of the reducing agent per mol of the oxidizing agent.

Preferred examples of the nucleophilic agent which can be used in the present invention include sodium hydroxide, potassium hydroxide, guanidine and the salts thereof, and amines and the salts thereof.

Preferred examples of the silver ion complex forming agent which can be used in the present invention include thiourea and the derivatives thereof (e.g., N-methylthiourea, N,N'-dimethylthiourea, etc.), pyridinium derivatives (e.g., 2-ethyl-1-(3-phenylpropyl)-pyridinium bromide, etc.), and thiazolinethione derivatives (e.g., carboxymethyl-4-methyl-4-thiazolin-2-thione, etc.).

Preferred examples of the electron transferring agent which can be used in the present invention include quinoxaline, dimethylquinoxaline, phenazine, anthraquinone, and pyrazine.

In the heat-developable color photographic material of the present invention, various kinds of bases, base releasing agents and water releasing compounds can be employed. By the use of the base, base releasing agent or water releasing compound, a desirable color image can be obtained at a lower temperature.

Examples of preferred bases are amines which include a trialkylamine, a hydroxyalkylamine, an aliphatic polyamine, an N-alkyl substituted aromatic amine, an N-hydroxyalkyl substituted aromatic amine and a bis[p-(dialkylamino)phenyl]methane. Further, betaine tetramethylammonium iodide and diaminobutane dihydrochloride as described in U.S. Pat. No. 2,410,644, and urea and an organic compound including an amino acid such as 6-aminocaproic acid as described in U.S. Pat. No. 3,506,444 are useful. The base releasing agent is a compound or a mixture which releases a basic component by heating, and the basic component is capable of activating the photographic material. Examples of typical base releasing agents are described in British Pat. No. 998,949. Preferred base releasing agents include a salt of a carboxylic acid and an organic base, and examples of suitable carboxylic acids include trichloroacetic acid and trifluoroacetic acid, etc., and examples of suitable bases include guanidine, piperidine, morpholine, p-toluidine and 2-picoline, etc. Guanidine trichloroacetate as described in U.S. Pat. No. 3,220,846 is particularly preferred. Further, an aldonic amide as described in Japanese Patent Application (OPI) No. 22625/75 is preferably used because it decomposes at high temperature to form a base.

Further, in the heat-developable color photographic material of the present invention, many known compounds which activate development and simultaneously stabilize the image can be effectively used. Of these compounds, an isothiuronium including 2-hydroxyethylisothiuronium trichloroacetate as described in U.S. Pat. No. 3,301,678, a bisisothiuronium including 1,8-(3,6-dioxaoctane)-bis(isothiuronium trichloroacetate), etc., as described in U.S. Pat. No. 3,669,670, a thiol compound as described in West German Patent Application (OLS) No. 2,162,714, a thiazolium compound such as 2-amino-2-thiazolium trichloroacetate and 2-amino-5-bromoethyl-2-thiazolium trichloroacetate, etc., as described in U.S. Pat. No. 4,012,260, a compound having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and a compound having 2-carboxyamide as an acid part as described in U.S. Pat. No. 4,088,496, and the like are preferably used.

These compounds or mixtures thereof can be used in a wide range of amounts. It is preferable to use them in a range of 1/100 times to 10 times and, particularly 1/20 times to 2 times by molar ratio based on silver.

In the heat-developable color photographic material of the present invention, a diffusion accelerator can be incorporated. The term "diffusion accelerator" means a non-hydrolyzable organic compound which is solid at an ambient temperature but melts at a temperature lower than the heat treatment temperature to be used. In a case wherein a dye imagewise released is transferred into a support, those which can get into the support during the heat treatment are preferred. Examples of preferred diffusion accelerators include diphenyl, o-phenylphenol, phenol, resorcinol and pyrogallol, etc. As the diffusion accelerator, a compound which is used as a thermal solvent can be used. One of the photographic element (I) and the image receiving element (II) contains a diffusion accelerator.

The term "thermal solvent" means a non-hydrolyzable organic material which is solid at an ambient temperature but melts together with other components at a temperature of heat treatment or a temperature lower than the heat treatment temperature. As the thermal solvent, a compound which becomes a solvent for the developing agent and a compound having a high dielectric constant which accelerate physical development of the silver salt, etc., are useful. Preferred examples of the thermal solvents include a polyglycol as described in U.S. Pat. No. 3,347,675, for example, polyethylene glycol having an average molecular weight of 1,500 to 20,000, a derivative of polyethylene oxide such as an oleic acid ester thereof, etc., beeswax, monostearin, a compound having a high dielectric constant which has an —$SO_2$— or —CO— group such as acetamide, succinimide, ethylcarbamate, urea, methylsulfonamide, ethylene carbonate, a polar substance as described in U.S. Pat. No. 3,667,959, lactone of 4-hydroxybutanoic acid, methylsulfinylmethane, tetrahydrothiophene-1,1-dioxide, and 1,10-decanediol, methyl anisate, biphenyl suberate, etc., as described in Research Disclosure, pages 26 to 28 (Dec., 1976), etc. More preferred examples of the diffusion accelerator which can be used in the present invention include a thermal solvent selected from a high boiling point solvent, polyethylene glycol, a derivative of an ester of oleic acid of polyethylene oxide and wax.

For preventing irradiation or halation and improving the sharpness a filter dye or a light absorbing material as described in Japanese Patent Publication No. 3692/73, U.S. Pat. Nos. 3,253,921, 2,527,583 and 2,956,879, etc., can be incorporated. Preferably, these dyes have a thermally bleaching property. For example, dyes as described in U.S. Pat. No. 3,769,019, 3,745,009 and 3,615,432 are preferred.

The photographic material according to the present invention may contain, if desired, various additives known for the heat-developable photographic material and may have an antistatic layer, an electrically conductive layer, a protective layer, an intermediate layer, an antihalation layer and a strippable layer, etc., in addition to the light-sensitive layer. As the additives, those described in Research Disclosure, Vol. 170, No. 17029 (June, 1978), for example, a plasticizer, a dye for improving sharpness, an antihalation dye, a sensitizing dye, a matting agent, a surface active agent, a fluorescent whitening agent, a fade preventing agent, etc., may be used.

The support used in the present invention is that which can endure at the processing temperature. Examples of useful common supports include not only glass, paper, metal and analogues thereof, but also an acetyl cellulose film, a cellulose ester film, a polyvinyl acetal film, a polystyrene film, a polycarbonate film, a polyethylene terephthalate film and films related to them and a plastic material. Polyesters described in U.S. Pat. Nos. 3,634,089 and 3,725,070 are suitably used. Polyethylene terephthalate films are particularly preferred.

The protective layer, the intermediate layer, the subbing layer, the back layer and other layers can be produced by preparing each coating solution and applying in order to the support by various coating methods such as a dip coating method, an air-knife coating method, a curtain coating method, a hopper coating method, as described in U.S. Pat. No. 2,681,294 and drying to prepare the photographic material, in a manner similar to the heat-developable light-sensitive layer according to the present invention. If desired, two or more layers may be applied at the same time by the method as described in U.S. Pat. No. 2,761,791 and British Pat. No. 837,095.

For the heat-developable photographic material of the present invention, various means for exposing to light can be used. A latent image is obtained by imagewise exposure to radiant rays including visible rays. Generally, a light source used for conventional color prints can be used, examples of which include a tungsten lamp, a mercury lamp, a halogen lamp such as an iodine lamp, etc., a xenon lamp, a laser light source, a CRT light source, a fluorescent tube, a light-emitting diode, etc.

As the original, not only a line drawing but a photograph having gradation may be used. It is also possible to take a photograph of a portrait or landscape by means of a camera. Printing from the original may be carried out by contact printing by superimposing the original on the photographic material or may be carried out by reflection printing or enlargement printing.

Further, it is possible to carry out the printing of an image photographed by a videocamera or image information sent from a television broadcasting station by displaying directly on CRT or FOT and forcusing the resulting image on the heat-developable photographic material by contacting therewith or by means of a lens.

Recently, LED (light-emitting diode) which has been greatly improved is utilized as an exposure means or display means for various apparatus and devices. It is difficult to produce LED which effectively emits blue light. In this case, in order to reproduce the color image, three kinds of LED consisting of those emitting each green light, red light and infrared light are used, and the packet emulsions sensitive to these lights are designed so as to be incorporated a yellow, magenta and cyan color image forming substance, respectively. Namely, the photographic material is produced in such a manner that the green-sensitive packet emulsion contains a yellow color image forming substance, the red-sensitive packet emulsion contains a magenta color image forming substance and the infrared-sensitive packet emulsion contains a cyan color image forming substance. Other combinations can be utilized, if desired.

Besides the above described methods for contact exposure or projection of the original, there can be used a method of exposure wherein the original illuminated by a light source is stored in a memory of a leading computer by means of a light-receiving element such as a phototube or CCD, etc., the information is, if desired, subjected to processing, the so-called image treatment, and the resulting image information is reproduced on CRT to utilize as an imagelike light source or three kinds of LED are emitted according to the processed information.

After the heat-developable color photographic material is exposed to light, the latent image thus obtained can be developed by heating the whole material at a suitably elevated temperature, for example, from about 80° C. to about 250° C. for from about 0.5 second to about 300 seconds, preferably 0.5 second to 120 seconds. Any higher temperature or lower temperature can be utilized by prolonging or shortening the heating time, if it is within the above described range. Particularly, a temperature range from about 120° C. to about 190° C. is useful. As a heating means, a simple heat plate, an iron, a heat roller or analogues thereof may be used.

The heat-developable color photographic material of the present invention can be composed of only a photographic element (I) comprising a packet emulsion containing at least silver halide, an organic silver salt oxidizing agent and a color image forming substance, a reducing agent, and a hydrophilic binder, etc., provided on a support. However, it is preferred that the photographic material is composed of the photographic element (I) and an image receiving element (II) capable of forming an image consisting of dye upon diffusion transfer of the color image dye formed.

The above described photographic element (I) and the image receiving element (II) may be formed on the same support, or they may be formed on different supports, respectively. When the above described photographic element (I) and the image receiving element (II) is formed on the same support, the image receiving element (II) and the photographic element (I) are coated in this order on the support. The image receiving element (II) can be stripped off the photographic element (I). For example, after the heat-developable color photographic material is exposed imagewise to light, it is developed by heating uniformly and thereafter the image receiving element is peeled apart.

In accordance with another process, after the heat-developable color photographic material is exposed imagewise to light, the photographic element (I) can be developed by heating uniformly by superposing the image receiving element (II) on the photographic element. Further, after the heat-developable color photographic material is exposed imagewise to light and developed by heating uniformly, the dye can be transferred on the image receiving element (II) by superposing the image receiving element thereon and heating to a temperature lower than the developing temperature.

The image receiving element (II) can contain a dye mordant. In the present invention, various mordants can be used, and a useful mordant can be selected according to properties of the dye, conditions for transfer, and other components contained in the photographic material, etc. Useful mordants are polymers containing ammonium salt groups which are described in U.S. Pat. No. 3,709,690. An example of useful polymers containing ammonium salt groups is poly(styrene-co-N,N,N-tri-n-hexyl-N-vinylbenzylammonium chloride) wherein the ratio of styrene and vinyl benzylammonium chloride is about 1:4 to about 4:1 and, preferably, 1:1. Typical diffusion transfer photographic materials are obtained by mixing the polymer containing ammonium salt groups with gelatin and applying the mixture to a transparent support. The transfer of dyes on the heat-developable color light-sensitive layer to the image receiving layer can be carried out using a transfer solvent. As the transfer solvent, it is possible to use solvents having a low boiling point such as methanol, ethyl acetate or diisobutyl ketone, etc., and solvents having a high boiling point such as tri-n-cresylphosphate, tri-n-nonyl phosphate or di-n-butyl phthalate, etc. When using solvents having a high boiling point, they can be added to the mordant layer by emulsifying in gelatin using a suitable emulsifier.

Preferred examples of the dye mordant which can be used in the present invention include a low boiling point solvent or water.

After the application of the dye mordant, the heat-developable diffusion transfer color photographic material is heated at a temperature from 40° C. to 120° C., preferably 50° C. to 80° C. for from 0.5 sec. to 60 sec., preferably 0.5 to 30 sec. to diffusion transfer the dye image from the light-sensitive layer (I) to the image receiving layer (II).

In another process, a layer of titanium dioxide dispersed in gelatin can be provided on the mordant layer on the transparent support. The layer of titanium dioxide forms a white or opaque layer, by which reflection color images of the transferred color images which are observed through the transparent support are obtained.

Furthermore, it is also possible to use a support composed of a plastic film as an image receiving element and the transferred color image is formed in the support. In this case, a heat-developable color photographic element containing a packet emulsion, etc., is applied to the support and the photographic material thus prepared is subjected to heat development to form or release a dye which is then heat-transferred into the support thereby the transferred color image is formed in the support. By peeling the coated layer apart from the support, only the transferred color image thus formed can be observed.

A heat-developable light-sensitive photographic composition which can be used in the present invention comprises (a) a packet emulsion prepared by forming fine droplets of complex coacervate containing (i) a light-sensitive silver halide spectrally sensitized, if desired, (ii) an organic silver salt oxidizing agent and (iii) a color image forming substance by complex coacervation and hardening the fine droplets with a hardening agent; (b) a reducing agent; and (c) a hydrophilic binder.

The present invention will be explained in greater detail with reference to the following examples, but the present invention should not be construed as being limited thereto.

EXAMPLE 1

6.5 g of benzotriazole and 10 g of gelatin were dissolved in 1,000 ml of water and the solution was stirred while maintaining at 50° C. A solution containing 8.5 g of silver nitrate dissolved in 100 ml of water was added to the above described solution for a period of 2 minutes and thus silver benzotriazole was formed. Then, a solution containing 1.19 g of KBr and 0.083 g of KI dissolved in 50 ml of water was added to the above described mixture for a period of 5 minutes. It is believed that on this step silver was supplied from the silver benzotriazole to form crystals of AgBrI (I: 20 mol%) adjacent to the silver benzotriazole. By controlling the pH of the emulsion thus prepared to form a precipitate the undesirable salts were removed. The pH of the emulsion was adjusted to 6.0 and 400 g of the emulsion was obtained.

EXAMPLE 2

6.5 g of benzotriazole and 10 g of gelatin were dissolved in 1,000 ml of water and the solution was stirred while maintaining at 50° C. A solution containing 8.5 g of silver nitrate dissolved in 100 ml of water was added to the above described solution for a period of 2 minutes. By controlling the pH of the emulsion thus prepared to form a precipitate the undesirable salts were removed. The pH of the emulsion was adjusted to 6.0 and 400 g of silver benzotriazole emulsion was obtained.

EXAMPLE 3

To 1,000 ml of water, 20 g of gelatin, 9.52 g of KBr and 3.32 g of KI were dissolved and the solution was stirred while maintaining at 50° C. To the solution was added a solution containing 17 g of silver nitrate dissolved in 100 ml of water for a period of 10 minutes. Then, the mixture was cooled to 35° C. The pH of the emulsion was controlled to form a precipitate and the undesirable salts were removed. The pH of the emulsion was adjusted to 6.0 and 200 g of silver bromoiodide (I: 20 mol%) emulsion was obtained.

EXAMPLE 4

20 g of a coupler dispersion obtained by dissolving 10 g of Coupler (M-8) in 30 ml of tricresyl phosphate and dispersing the solution in 100 g of a 10% aqueous gelatin solution using 0.5 g of sodium dodecylbenzenesulfonate as an emulsifier and 35 g of the silver benzotriazole emulsion partially silver iodobrominated prepared in Example 1 were mixed and dissolved. To the mixture were added 30 ml of a 10% aqueous solution of gum arabic and 105 ml of water and while stirring at 45° C., the pH of the mixture was adjusted to 4.80 by adding a 1% aqueous solution of acetic acid. After stirring for 10 minutes, the mixture was cooled to not more than 10° C. and stirred for 30 minutes. 100 ml of water containing 0.14 g of chromium alum was added, the mixture was stirred for 30 minutes and then the pH was adjusted to 6.5 by adding a 5% aqueous solution of sodium carbonate. The mixture was allowed to stand overnight and the supernatant liquid was removed by decantation. The yield of the packet emulsion precipitated was 103 g and the average packet size was about 20 μm.

EXAMPLE 5

A packet emulsion was prepared in the same manner as described in Example 4, except using 30 ml of a 1% aqueous solution of a copolymer of naphthalenesulfonic acid and formulin (1:1) in place of 30 ml of the 10% aqueous solution of gum arabic and removing a suprenatant liquid by treating the mixture using a centrifugal separator at 3,000 rpm for 10 minutes in place of removing the supernatant liquid by allowing to stand overnight after the formation of the packet emulsion. The yield of the packet emulsion was 95 g and the average packet size was about 5 μm.

EXAMPLE 6

20 g of a coupler dispersion obtained by dissolving 10 g of Coupler (C-3) in 30 ml of dibutyl phthalate and dispersing the solution in 100 g of a 10% aqueous gelatin solution containing 10 ml of a 5% aqueous solution containing sodium dodecylbenzenesulfonate, 30 g of the silver benzotriazole emulsion prepared in Example 2 and 4 g of the silver halide emulsion prepared in Example 3 were mixed and dissolved. To the mixture were added 30 ml of a 1% aqueous solution of a condensation product of naphthalenesulfonic acid and formalin (1:1) and 120 of water and while stirring at 45° C. the pH of the mixture was adjusted to 4.60 by adding dropwise a 1% aqueous solution of acetic acid. After stirring for 15 minutes, the mixture was cooled to not more than 10° C. and stirred for 30 minutes. 100 ml of water containing 0.14 g of chromium alum was added, the mixture was stirred for 30 minutes and then a packet emulsion was collected by suction filtration using a paper filter. The yield of the packet emulsion was 145 g and the average packet size was about 15 μm.

EXAMPLE 7

A coupler dispersion was prepared by dissolving 10 g of Coupler (M-5) in 30 ml of tricresyl phosphate and dispersing the solution in 110 g of a 10% aqueous gelatin solution containing 0.5 g of sodium dodecylbenzenesulfonate.

4 g of the silver iodobromide emulsion prepared in Example 3 was dissolved, to which was added $4\times10^{-4}$ mol of 3,3'-di(γ-sulfopropyl)-5,5'-diphenyl-9-ethyloxacarbocyanine sodium salt per mol of the silver halide and stirred for 5 minutes. Then, 20 g of the above described coupler dispersion and 30 g of the silver benzotriazole emulsion prepared in Example 2 were added to the mixture and dissolved.

To the mixture were added 30 ml of a 10% aqueous solution of gum arabic and 100 ml of water and while stirring at 45° C. the pH of the mixture was adjusted to 4.80 by adding a 1% aqueous solution of acetic acid. After stirring for 15 minutes, the mixture was cooled to 7° C. and stirred for 30 minutes. 150 ml of water containing 0.14 g of chromium alum was added, the mixture was stirred for 1 hour and then a 5% aqueous sodium carbonate solution was added thereto. The mixture was allowed to stand overnight and the supernatant liquid was removed by decantation. The yield of the packet emulsion thus prepared was 90 g and the average packet size was about 10 μm.

EXAMPLE 8

A coating solution containing 3 g of the dispersion of Coupler (M-5) prepared in Example 7, 10 g of the silver benzotriazole emulsion prepared in Example 2, 2 g of the silver iodobromide emulsion spectrally sensitized to green light in the same manner as described in Example 7, 15 ml of water, 0.1 g of guanidine trichloroacetate and 0.1 g of 2,6-dichloro-p-aminophenol as a reducing agent was coated on a polyethylene terephthalate film at a wet thickness of 100 μm and dried. Then, a gelatin protective layer (1 g of gelatin per $m^2$) was coated on the emulsion layer to prepared Sample 810.

Sample 811 was prepared in the same manner as described in Sample 810 except using 15 g of the packet emulsion prepared in Example 7 in place of the dispersion, the silver benzotriazole emulsion, the silver iodobromide emulsion and water (wherein a coated amount of gelatin was the same as in Sample 810).

Samples 820, 830, 840, 850 and 860 were prepared in the same manner as described in Sample 810 except using the coupler, the sensitizing dye and the reducing agent as shown in Table 1 below in place of those used in Sample 810.

Samples 821, 831, 841, 851 and 861 were prepared in the same manner as described in Sample 811 except using the coupler, the sensitizing dye and the reducing agent as shown in Table 1 below in place of those used in Sample 811.

These samples were exposed to blue light, green light and red light depending on the spectral sensitivity range of the samples, respectively, and subjected to development by heating on a hot panel at 140° C. for 30 seconds. Further, these samples were stored for 14 days at room temperature and then subjected to exposure to light and heat development in the same manner.

The densities of the fog area and the maximum color density area ($D_{min}$ and $D_{max}$, respectively) of the samples thus heat-developed were measured through a filter having a complementary color with respect to color of the dye formed using a Macbeth transmission densitometer. The results thus obtained are shown in Table 1 below.

From the results shown in Table 1 it is apparent that Samples 811, 821, 831, 841, 851 and 861 using the packet emulsion have fairly low $D_{min}$ while $D_{max}$ being almost the same in comparison with Samples 810, 820, 830, 840, 850 and 860. This is particularly remarkable with the samples stored before exposure. This indicates that the fog formation of the heat-developable color photographic material is restrained by using the packet containing the coloring material and the emulsion.

TABLE 1

| Sample No. | Sensitizing Dye | Coupler | Reducing Agent | Fresh $D_{max}$ | Fresh $D_{min}$ | Stored (14 days) $D_{max}$ | Stored (14 days) $D_{min}$ | Remarks |
|---|---|---|---|---|---|---|---|---|
| 810 | (a)* | (M-5) | (d)* | 2.50 | 0.32 | 2.52 | 1.43 | Comparison |
| 820 | (a) | (M-8) | (e)* | 2.13 | 0.30 | 2.20 | 1.20 | " |
| 830 | (b)* | (Y-7) | (d) | 1.50 | 0.29 | 1.48 | 0.93 | " |
| 840 | (b) | (Y-8) | (f)* | 1.34 | 0.30 | 1.35 | 0.77 | " |
| 850 | (c)* | (C-3) | (d) | 3.03 | 0.36 | 3.00 | 1.87 | " |
| 860 | (c) | (C-5) | (g)* | 3.10 | 0.31 | 3.21 | 1.56 | " |
| 811 | (a) | (M-5) | (d) | 2.33 | 0.25 | 2.35 | 0.59 | Present Invention |
| 821 | (a) | (M-8) | (e) | 2.10 | 0.22 | 2.19 | 0.47 | " |
| 831 | (b) | (Y-7) | (d) | 1.30 | 0.18 | 1.29 | 0.25 | " |
| 841 | (b) | (Y-8) | (f) | 1.25 | 0.20 | 1.30 | 0.38 | " |
| 851 | (c) | (C-3) | (d) | 2.61 | 0.19 | 2.60 | 0.45 | " |
| 861 | (c) | (C-5) | (g) | 2.44 | 0.16 | 2.49 | 0.40 | " |

Sensitizing Dye
(a)*: 3,3'di(γ-sulfopropyl)-5,5'-diphenyl-9-ethyloxacarbocyanine sodium salt
(b)*: 3,3'-di(γ-sulfopropyl)selena-cyanine sodium salt
(c)*: 3,3'-di(γ-sulfopropyl)-9-methyl-thiadicarbocyanine sodium salt
Reducing Agent
(d)*: 2,6-dichloro-p-aminophenol
(e)*: 2,6-dibromo-p-aminophenol
(f)*: 2-chloro-6-acetamido-p-amino-phenol
(g)*: N,N—diethyl-3-methyl-p-phenylene-diamine

EXAMPLE 9

On a polyethylene terephthalate film, the following layers described below were coated in this order to prepare Sample 910.

First layer (Red-sensitive emulsion layer): The same as the image forming layer of Sample 850 in Example 8.

Second layer (Intermediate layer): A gelatin layer (gelatin: 1 g/m$^2$)

Third layer (Green-sensitive emulsion layer): The same as the image forming layer of Sample 810 in Example 8.

Fourth layer (Intermediate layer): A gelatin layer (gelatin: 1 g/m$^2$)

Fifth layer (Blue-sensitive emulsion layer): The same as the image forming layer of Sample 830 in Example 8.

Sixth layer (Protective layer): A gelatin layer (gelatin: 1 g/m$^2$)

Further, 10 g of each of the packet emulsions prepared in Samples 811, 831 and 851 of Example 8 and 15 g of a 10% aqueous gelatin solution were mixed and dissolved. To the mixture were added 0.2 g of guanidine trichloroacetate and 2 ml of a 10% methanol solution of 2,6-dichloro-p-aminophenol as a reducing agent and the resulting mixture was coated at a wet thickness of 280 μm. The sample thus prepared was designated Sample 911.

Samples 910 and 911 were exposed to blue light, green light and red light and subjected to development by heating on a heat panel at 160° C. for 15 seconds. As is apparent from the results shown in Table 2 below, the fog densities ($D_{min}$) of all three colors in Sample 911 are considerably lower than those of Sample 910. Therefore, in Sample 911, the color purities of the cyan, magenta and yellow color images are rather high in comparison with Sample 910.

TABLE 2

| Sample | $D_{min}^R$ | $D_{min}^G$ | $D_{min}^B$ |
|---|---|---|---|
| 910 | 0.36 | 0.41 | 0.29 |
| 911 | 0.20 | 0.25 | 0.19 |

EXAMPLE 10

Samples 1011, 1021 and 1031 were prepared in the following manner.

Sample 1011

The sample was prepared in the same manner as described in Sample 911 of Example 9.

Sample 1021

The sample was prepared in the same manner as described in Sample 911 of Example 9 except using a coupler dispersion containing 0.3 g of 2,6-dichloro-p-aminophenol in the coupler solvent at the preparation of the packet emulsion of Example 7 and not adding the above described reducing agent at the time of coating.

Sample 1031

The sample was prepared in the same manner as described in Sample 911 of Example 9 except using a coupler dispersion containing 0.3 g of 2,6-dichloro-p-aminophenol in the coupler solvent and 0.3 g of guanidine trichloroacetate in the gelatin phase at the preparation of the packet emulsion of Example 7 and not adding the reducing agent and the alkali releasing agent described above at the time of coating.

Samples 1011, 1021 and 1031 thus prepared were subjected to three color separation exposure using blue light, green light and red light and developed by heating on a heat panel at 160° C. for 15 seconds. Further, these coated samples were stored for 14 days under an ambient condition and then subjected to exposure to light and heat development. As is apparent from the results shown in Table 3 below, these samples have the sufficient color forming property but there are various differences with respect to the fog density. These results indicate that when the base releasing agent and the reducing agent were dispersed out of the packet emulsion, the formation of color fog during the preparation step and storage of the photographic material can be more restrained in comparison with the case wherein the base releasing agent and the reducing agent were present in the packet emulsion.

TABLE 3

| Sample | Alkali Releasing Agent | Reducing Agent | Fresh $D^R_{min}$ | Fresh $D^G_{min}$ | Fresh $D^B_{min}$ | Stored under Ambient Condition (14 days) $D^R_{min}$ | Stored under Ambient Condition (14 days) $D^G_{min}$ | Stored under Ambient Condition (14 days) $D^B_{min}$ |
|---|---|---|---|---|---|---|---|---|
| 1011 | Out of packet | Out of packet | 0.21 | 0.24 | 0.19 | 0.43 | 0.55 | 0.33 |
| 1021 | " | In packet | 0.29 | 0.30 | 0.24 | 0.93 | 0.98 | 0.58 |
| 1031 | In packet | " | 0.33 | 0.39 | 0.25 | 1.06 | 1.15 | 0.67 |

EXAMPLE 11

Samples 910 and 911 of Example 9 were exposed stepwise to blue light, green light and red light, superposed on an image receiving sheet containing a mordant swollen with tributyl phosphate, heated on a heat panel at 160° C. for 30 seconds and then peeled apart from each other.

The image receiving sheet used comprised on a transparent polyethylene terephthalate film, a titanium dioxide layer and a dye mordanting layer in this order. The mordant was a polymer containing quaternary ammonium groups and a copolymer of polystyrene and poly(N,N,N-tri-n-hexyl-N-vinylbenzylammonium chloride) in a ratio of 1:1.

By the heat treatment described above, cyan, magenta and yellow three color negative images were obtained on the image receiving sheet. The color image densities with the maximum value and the minimum value were measured using a Macbeth reflection densitometer (HD-219). The results obtained are shown in Table 4 below.

TABLE 4

| Sample | Yellow Density $D_{max}$ | Yellow Density $D_{min}$ | Magenta Density $D_{max}$ | Magenta Density $D_{min}$ | Cyan Density $D_{max}$ | Cyan Density $D_{min}$ |
|---|---|---|---|---|---|---|
| 910 (Comparsion) | 1.53 | 0.50 | 0.82 | 0.45 | 0.69 | 0.29 |
| 911 (Present Invention) | 1.39 | 0.35 | 2.80 | 0.39 | 2.05 | 0.35 |

From the results shown in Table 4, it is apparent that with Sample 911 according to the present invention the magenta color image and the cyan color image are sufficiently transferred. On the contrary, the transfer of the magenta color image and the cyan color image is insufficient with Sample 910 for comparison.

EXAMPLE 12

Samples 1210 and 1211 were prepared in the same manner as described in Samples 910 and 911 of Example 9 except using Color Image Forming Substance (VII-4) in place of Coupler (C-3), Color Image Forming Substance (VII-2) in place of Coupler (Y-7) and Color Image Forming Substance (VII-12) in place of Coupler (M-5), respectively.

These samples were subjected to three color separation exposure in the same manner as described in Example 11 and heated on a heat panel at 160° C. for 30 seconds. After cooling to room temperature, the photographic material was superposed on an image receiving sheet same as used in Example 11 swoolen with methanol and they were kept at 50° C. for 20 seconds. As a result, yellow, magenta and cyan negative images were obtained on the image receiving sheet. The maximum reflective density ($D_{max}$) and the fog density ($D_{min}$) of each color image were measured through a filter having a complementary color with respect to color of the dye formed using a Macbeth reflection densitometer (HD-219). The results obtained are shown in Table 5 below. From the results shown in Table 5 it is apparent that the transferring property greatly decreases in the order of yellow, magenta and cyan with Sample 1210. On the other hand, with Sample 1211 according to the present invention the three colors are sufficiently transferred in good balance and $D_{min}$ of each of the colors is low.

TABLE 5

| Sample | Yellow Density $D_{max}$ | Yellow Density $D_{min}$ | Magenta Density $D_{max}$ | Magenta Density $D_{min}$ | Cyan Density $D_{max}$ | Cyan Density $D_{min}$ |
|---|---|---|---|---|---|---|
| 1210 | 1.20 | 0.80 | 0.85 | 0.51 | 0.39 | 0.22 |
| 1211 | 1.15 | 0.45 | 1.20 | 0.38 | 1.53 | 0.35 |

EXAMPLE 13

Sample 1311 was prepared in the same manner as described in Sample 1211 of Example 12 except using Color Image Forming Substance (VII-1) in place of Color Image Forming Substance (VII-12).

The sample was subjected to three color separation exposure in the same manner as described in Example 11 and heated on a heat panel at 170° C. for 45 seconds. A tape having an adhesive type binding agent layer was adhered to the emulsion side of the photographic material and then the emulsion layer was peeled apart. In the polyethylene terephthalate film support the transferred yellow, magenta and cyan color negative images separated three color were observed. The maximum transmission densities of each dye measured by a Macbeth transmission densitometer were 0.62 in yellow, 0.75 in magenta and 0.85 in cyan, respectively. Also, the fog densities were 0.18 in yellow, 0.15 in magenta and 0.17 in cyan, respectively.

EXAMPLE 14

On a transparent polyethylene terephthalate film support were coated in order a mordanting layer containing a copolymer of polyethylene and poly(N,N,N-tri-n-hexyl-N-vinylbenzyl ammonium chloride) in a ratio of 1:1 and a layer containing polyvinyl butyral and titanium dioxide. Then the following layers were coated in order on the titanium dioxide layer to prepare Sample 1410.

First layer: 3 g of a dispersion obtained by dissolving 10 g of Color Image Forming Substance (XV-12) in 30 ml of N,N-diethyllaurylamide and dispersing the solution in 100 g of a 10% aqueous gelatin solution containing 0.5 g of sodium dodecylbenzenesulfonate and 15 g of the partially halogenated silver benzotriazole emulsion prepared as in Example 1 and spectrally sensitized to red light with Sensitizing Dye (c) (refer to Example 8) were mixed and dissolved, to which 0.1 g of guanidine trichloroacetate and 15 ml of water were added, and the resulting coating solution was coated at a wet thickness of 100 μm.

Second layer: A gelatin intermediate layer (coating amount: 1 g/m$^2$).

Third layer: Same as in the first layer except using Color Image Forming Substance (XV-18) in place of Color Image Forming Substance (XV-12) and Sensitizing Dye (b) in place of Sensitizing Dye (c), respectively.

Fourth layer: A gelatin intermediate layer (coating amount: 1 g/m$^2$).

Fifth layer: Same as in the first layer except using Color Image Forming Substance (XV-13) in place of Color Image Forming Substance (XV-12) and Sensitizing Dye (a) in place of Sensitizing Dye (c), respectively.

Sixth layer: A gelatin protective layer (coating amount: 1 g/m$^2$).

Then, three kinds of packet emulsions PE-(1), (2) and (3) were prepared in the same manner as described in Example 7 except using the coupler, coupler solvent, emulsion and sensitizing dye as shown in Table 6 below in the preparation of the packet emulsion.

TABLE 6

| | Example 7 | PE-(1) | PE-(2) | PE-(3) |
|---|---|---|---|---|
| Coloring Material | Coupler (M-5) | (XV-12) | (XV-18) | (XV-13) |
| Solvent | Tricresyl phosphate | N,N—diethyl-laurylamide | N,N—diethyl-laurylamide | N,N—diethyl-laurylamide |
| Emulsion | Silver benzotriazole emulsion: 30 g + Silver iodobromide emulsion: 4 g | Emulsion used in Example 1: 35 g | Emulsion used in Example 1: 35 g | Emulsion used in Example 1: 35 g |
| Sensitizing Dye | (c) | (c) | (b) | (a) |

*Sensitizing Dyes (a), (b) and (c) used are described in Example 8.

10 g of each of packet emulsions PE-(1), (2) and (3) thus prepared and 15 g of a 10% aqueous gelatin solution were mixed and dissolved, to which was added 0.2 g of guanidine trichloroacetate and the resulting mixture was coated at a wet thickness of 280 μm. On the layer, a gelatin protective layer (2 g/m$^2$) was coated to prepare Sample 1411.

Samples 1410 and 1411 thus prepared were exposed to light as described in Example 11 and heated on a heat panel at 150° C. for 30 seconds. The negative color image transferred in the emulsion layer was measured from the support side using a Macbeth reflection densitometer. As is apparent from the results shown in Table 7 below, with Sample 1411 the transferred densities in all these colors are high while the maximum densities of the magenta and yellow dyes are remarkably low in comparison with the maximum density of the cyan dye with Sample 1410.

TABLE 7

| Sample | $D_{max}$ (cyan) | $D_{max}$ (magenta) | $D_{max}$ (yellow) |
|---|---|---|---|
| 1410 | 1.56 | 0.59 | 0.31 |
| 1411 | 1.50 | 1.38 | 1.30 |

While the invention has been described in detail and with reference to specific embodiments thereof, it will be apparent to one skilled in the art that various changes and modifications can be made therein without departing from the spirit and scope thereof.

What is claimed is:

1. A heat-developable color photographic material comprising a support having thereon a layer containing (a) fine droplets of complex coacervate containing a light-sensitive silver halide, an organic silver salt oxidizing agent and a color image forming substance which are prepared by complex coacervation and hardened with a hardening agent, (b) a compound that functions as a reducing agent and (c) a binder.

2. A heat-developable color photographic material as claimed in claim 1, wherein the complex coacervation comprises gelatin and an anionic polymer.

3. A heat-developable color photographic material as claimed in claim 2, wherein the anionic polymer is a compound having a repeating unit containing a $COO^-$ group, an $SO_3^-$ group or both groups and having a molecular weight of not less than 1,000.

4. A heat-developable color photographic material as claimed in claim 3, wherein the compound has a molecular weight of not less than 3,000.

5. A heat-developable color photographic material as claimed in claim 1, 2 or 3, wherein a size of the packet emulsion is from 1 μm to 100 μm.

6. A heat-developable color photographic material as claimed in claim 5, wherein the size of the packet emulsion is from 2 μm to 60 μm.

7. A heat-developable color photographic material as claimed in claim 5, wherein the size of the packet emulsion is from 5 μm to 30 μm.

8. A heat-developable color photographic material as claimed in claim 1, 2, 3 or 4, wherein the packet emulsion is prepared by the occurrence of coacervation using an aqueous solution of a cationic polymer and an aqueous solution of an anionic polymer, a concentration of the both solutions being from 0.5% to 6%.

9. A heat-developable color photographic material as claimed in claim 8, wherein the concentration of the both solutions is from 1% to 4%.

10. A heat-developable color photographic material as claimed in claim 1, 2, 3 or 4, wherein the packet emulsion is prepared by the occurrence of coacervation using an aqueous solution of a cationic polymer and an aqueous solution of an anionic polymer, a pH of the both solutions being from 5.2 to 4.0.

11. A heat-developable color photographic material as claimed in claim 10, wherein the pH of the both solutions is from 5.0 to 4.5.

12. A heat-developable color photographic material as claimed in claim 1, 2, 3 or 4, wherein the color image forming substance is a compound containing an azo dye, an azomethine dye, an anthraquinone dye, a naphthoquinone dye, a nitro dye, a styryl dye, a quinophthalone dye, a triarylmethane dye, a phthalocyanine dye or a precursor thereof.

13. A heat-developable color photographic material as claimed in claim 1, wherein the compound functioning as the reducing agent is a compound selected from an aromatic primary amine, a hydrazine compound and a derivative thereof, and the color image forming substance is a coupler capable of forming a dye by bonding to an oxidized product of the reducing agent.

14. A heat-developable color photographic material as claimed in claim 13, wherein the coupler is represented by the following general formula (I), (II), (III), (IV), (V) or (VI):

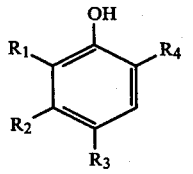
(I)

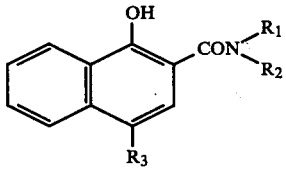
(II)

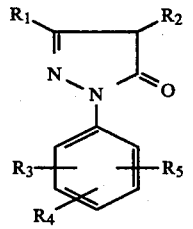
(III)

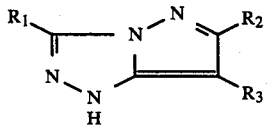
(IV)

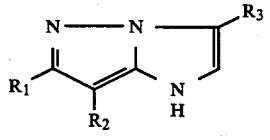
(V)

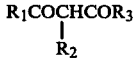
(VI)

wherein $R_1$, $R_2$, $R_3$, $R_4$ and $R_5$, which may be the same or different, each represents hydrogen or a substituent selected from the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group, a cyano group, an alkylsulfonyloxy group, an arylsulfonyloxy group, an alkylsulfonylamino group, an arylsulfonylamino group, an alkylthio group, an arylthio group, an arylazo group, a heterocyclic residue, a group of

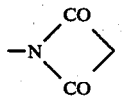

and a group of

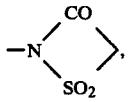

and these substituents may be further substituted with a hydroxy group, a carboxy group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

15. A heat-developable color photographic material as claimed in claim 1, wherein the compound functioning as the reducing agent is an aromatic primary amine and the color image forming substance is a compound capable of releasing a diffusible dye upon the coupling reaction with an oxidized product of the aromatic primary amine.

16. A heat-developable color photographic material as claimed in claim 15, wherein the dye image forming substance is represented by the following general formula (VII):

C—L—D (VII)

wherein C represents a moiety capable of bonding to an oxidized product which is formed by a reaction between a reducing agent and an organic silver salt oxidizing agent; D represents a dye portion for forming an image; and L represents a connection group between C and D and the bond between C and L is cleaved upon the reaction of C with the oxidized product of the reducing agent.

17. A heat-developable color photographic material as claimed in claim 16, wherein the moiety represented by C is an active methylene residue, an active methine residue, a phenol residue or a naphthol residue.

18. A heat-developable color photographic material is claimed in claim 17, wherein the moiety represented by C is represented by the following general formula (VIII), (IX), (X), (XI), (XII), (XIII) or (XIV):

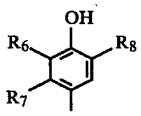
(VIII)

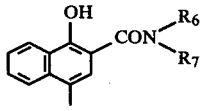
(IX)

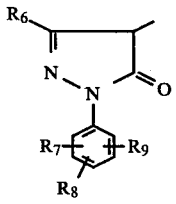
(X)

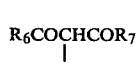
(XI)

-continued (XII)

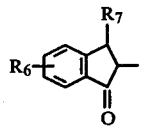

(XIII)

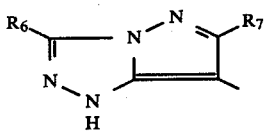

(XIV)

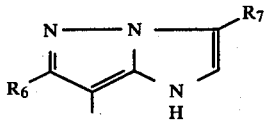

wherein $R_6$, $R_7$, $R_8$ and $R_9$, which may be the same or different, each represents hydrogen or a substituent selected from the group consisting of an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group and a cyano group, and these substituents may be further substituted with a hydroxyl group, a carboxyl group, a sulfo group, a cyano group, a nitro group, a sulfamoyl group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

19. A heat-developable color photographic material as claimed in claim 1, 2, 3 or 4, wherein the color image forming substance is a dye releasing redox compound capable of releasing a diffusible dye in the presence of a nucleophilic agent when the dye releasing redox compound is oxidized.

20. A heat-developable color photographic material as claimed in claim 19, wherein the dye releasing redox compound is represented by the following general formula (XV):

$$R—SO_2—D \qquad (XV)$$

wherein R represents a reducing group capable of being oxidized by the organic silver salt oxidizing agent; and D represents a dye portion for forming an image.

21. A heat-developable color photographic material as claimed in claim 20, wherein the reducing group represented by R is represented by the following general formula (XVI), (XVII), (XVIII), (XIX), (XX), (XXI), (XXII) or (XXIII):

(XVI)

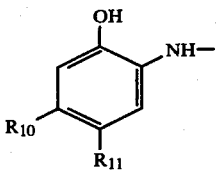

-continued (XVII)

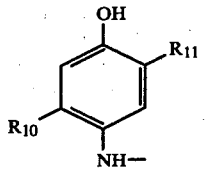

(XVIII)

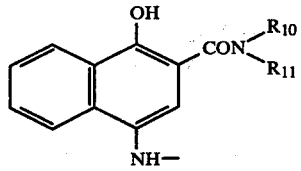

(XIX)

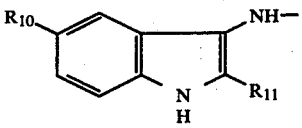

(XX)

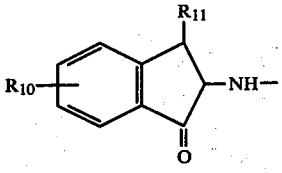

(XXI)

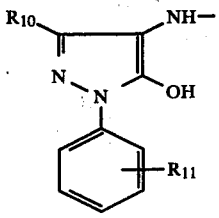

(XXII)

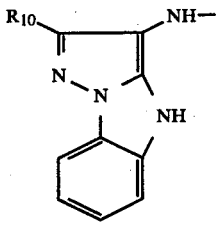

(XXIII)

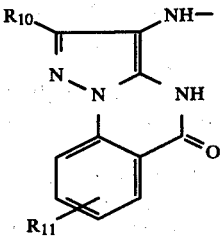

wherein $R_{10}$ and $R_{11}$, which may be the same or different, each represents hydrogen or a substituent selected from the group consisting of an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group and an N-substituted sulfamoyl group, and these substituents may be further substituted with a hydroxyl group, a carboxyl group, a sulfo group, a cyano group, a sulfamoyl group, a carbamoyl group, an acylamino group, an alkylsulfonylamino group, an arylsulfonylamino group, a ureido group or a substituted ureido group.

22. A heat-developable color photographic material as claimed in any of claims 1, 2, 3 or 4, wherein the binder is gelatin.

23. A heat-developable color photographic material as claimed in any of claims 1, 2, 3 or 4, wherein the organic silver salt oxidizing agent is an N-containing organic silver salt oxidizing agent.

24. A heat-developable color photographic material as claimed in any of claims 1, 2, 3, or 4, wherein the organic silver salt oxidizing agent is a silver salt of a triazole.

25. A heat-developable color photographic material as claimed in any of claims 1, 2, 3 or 4, wherein the color photographic material further contains a silver salt stabilizing agent.

26. A heat-developable color photographic material as claimed in any of claims 1, 2, 3 or 4, wherein the color photographic material further contains an accelerator for color image forming reaction.

27. A heat-developable color photographic material as claimed in claim 26, wherein the accelerator for color image forming reaction is selected from the group consisting of a base, a base releasing compound or a water releasing compound.

28. A heat-developable color photographic material as claimed in any of claims 1, 2, 3 or 4, wherein the light-sensitive silver halide is spectrally sensitized.

29. A heat-developable color photographic material as claimed in claim 28, wherein each of a combination of a blue-sensitive silver halide emulsion and a yellow color image forming substance, a combination of a green-sensitive silver halide emulsion and a magenta color image forming substance, and a combination of a red-sensitive silver halide emulsion and a cyan color image forming substance is incorporated into a separate packet emulsion.

30. A heat-developable color photographic material as claimed in claim 28, wherein each of a combination of a green-sensitive silver halide emulsion and a yellow color image forming substance, a combination of a red-sensitive silver halide emulsion layer and a magenta color image forming substance, and a combination of an infrared (700 to 800 nm) sensitive silver halide emulsion and a cyan color image forming substance is incorporated into a separate packet emulsion.

31. A heat-developable color photographic material as claimed in claims 1, 2, 3 or 4 wherein the compound functioning as the reducing agent is not part of the packet emulsion.

32. A heat-developable diffusion transfer color photographic material comprising a support having coated in order thereon a photographic element (I) comprising a packet emulsion prepared by forming fine droplets of complex coacervate containing a light-sensitive silver halide, an organic silver salt oxidizing agent and a color image forming substance by complex coacervation and hardening the fine droplets with a hardening agent, a hydrophilic binder and a reducing agent; and an image receiving element (II) comprising a mordant for a dye image formed or released by heat development in the photographic element.

33. A heat-developable diffusion transfer color photographic material as claimed in claim 32, wherein the image receiving element (II) and the photographic element (I) are coated in this order on the support.

34. A heat-developable diffusion transfer color photographic material as claimed in claim 32 or 33, wherein one of the photographic element (I) and the image receiving element (II) contains a diffusion accelerator.

35. A heat-developable diffusion transfer color photographic material as claimed in claim 34, wherein the diffusion accelerator is a thermal solvent selected from a high boiling point solvent, polyethylene glycol, a derivative of an ester of oleic acid of polyethylene oxide and wax.

36. A heat-developable photographic composition comprising (a) a packet emulsion prepared by forming fine droplets of complex coacervate containing (i) a light-sensitive silver halide spectrally sensitized, (ii) an organic silver salt oxidizing agent and (iii) a color image forming substance by complex coacervation and hardening the fine droplets with a hardening agent; (b) a reducing agent; and (c) a hydrophilic binder.

37. A method for forming a color image comprising the steps of:

providing a heat-developable color photographic material comprising a support having thereon a layer containing (a) fine droplets of complex coacervate containing light-sensitive silver halide, an organic silver salt oxidizing agent and a color image forming substance which are prepared by complex coacervation and hardening with a hardening agent, (b) a compound that functions as a reducing agent and (c) a binder;

image exposing the material; and heating the exposed material at a temperature of from 80° C. to 250° C.

38. A method of forming a color image as claimed in claim 37, wherein the heat-developable color photographic material is heated at a temperature from 120° C. to 190° C.

39. A method of forming a color image as claimed in claim 37 or 38, wherein the heat-developable color photographic material is heated for from 0.5 sec. to 120 sec.

40. A method for forming a color image, comprising the steps of: 'providing a heat-developable diffusion transfer color photographic material comprising a support having coated in order thereon a photographic element comprising a packet emulsion prepared by forming fine droplets of complex coacervate containing light-sensitive silver halide, in organic silver salt oxidizing agent and a color image forming substance by complex coacervation and hardening the fine droplets with a hardening agent, a hydrophilic binder and a reducing agent; and an image receiving element (II) comprising a mordant for a dye image;

imagewise exposing the material; and heating the exposed material at a temperature of 80° C. to 250° C. in order to bring about the development.

41. A method of forming a color image as claimed in claim 40, wherein the heat-developable diffusion transfer color photographic material is heated at a temperature from 120° C. to 190° C.

42. A method of forming a color image as claimed in claim 40 or 41, wherein the heat-developable diffusion transfer color photographic material is heated for from 0.5 sec. to 120 sec.

43. A method of forming a color image as claimed in claim 40 or 41, wherein after the exposure and the heating, a solvent is applied to a surface of the heat-developable diffusion transfer color photographic material to transfer the color image into the image receiving element (II).

44. A method of forming a color image as claimed in claim 43, wherein the solvent is a low boiling point solvent or water.

45. A method of forming a color image as claimed in claim 43 or 44, wherein after the application of the solvent, the heat-developable diffusion transfer color photographic material is heated at a temperature from 40° C. to 120° C. to diffusion transfer the dye image from the photographic element (I) to the image receiving element (II).

46. A method of forming a color image as claimed in claim 45, wherein the heat-developable diffusion transfer color photographic material is heated at a temperature from 50° C. to 80° C.

47. A method of forming a color image as claimed in claim 45, wherein the heat-developable diffusion transfer color photographic material is heated for from 0.5 sec. to 60 sec.

48. A method of forming a color image as claimed in claim 47, wherein the heat-developable diffusion transfer color photographic material is heated for from 0.5 sec. to 30 sec.

49. A heat-developable diffusion transfer color photographic material as claimed in any of claims 32 or 33, wherein the photographic element (I) and image receiving element (II) contain a diffusion accelerator.

50. A heat-developable color photographic material as claimed in claim 1, 2, 3 or 4 wherein the color image forming substance is a silver salt of silver salt forming dye capable of forming a diffusible dye when the silver salt of silver salt forming dye is reduced.

51. A heat-developable color photographic material as claimed in claim 50, wherein the silver salt of silver salt forming dye is represented by the following general formula (XXIV)

$$D—AH \qquad \text{(XXIV)}$$

wherein D represented a dye portion for forming color image; and AH represents an aliphatic or aromatic carboxylic acid group, a sulfonic acid group, a phosphoric acid group, a mercapto group, a group of NH or a phenolic hydroxy group.

52. A heat-developable color photographic material as claimed in claim 1, 2, 3 or 4, wherein the color image forming substance is a leuco body of a dye capable of being reduced or a precursor thereof capable of forming a dye when the leuco body or the precursor thereof is oxidized.

53. A heat-developable color photographic material as claimed in claim 52, wherein the dyes capable of being reduced include an azo dye, an azomethine dye, an anthraquinone dye, a naphthoquinone dye, a triarylmethane dye, a xanthene dye, an azine dye, an indigoid dye, a formazane dye, a nitro dye, a nitroso dye, or an azoxy dye.

54. A heat-developable color photographic material as claimed in claim 1, 2, 3 or 4, wherein the color image forming substance is a bleachable dye capable of being bleached by the action of metal silver, a silver ion complex forming agent and an electron transferring agent in the presence of an acid.

55. A heat-developable color photographic material as claimed in claim 54, wherein the bleachable dyes include an azo dye, an azoxy dye, an azomethine dye, a triarylmethane dye, a xanthene dye, an azine dye, an anthraquinone dye, a naphthoquinone dye, an indigoid dye, a nitro dye, a nitroso dye, or a formazane dye.

* * * * *